US006524158B1

(12) United States Patent
Fong

(10) Patent No.: US 6,524,158 B1
(45) Date of Patent: Feb. 25, 2003

(54) ANIMATED TOY

(76) Inventor: Peter Sui Lun Fong, 297F S. Atlantic Blvd., Monterey, CA (US) 91754

( * ) Notice: Subject to any disclaimer, the term of this patent is extended or adjusted under 35 U.S.C. 154(b) by 0 days.

(21) Appl. No.: 09/551,091

(22) Filed: Apr. 18, 2000

(51) Int. Cl.[7] ..... A63H 3/20; G09F 19/08
(52) U.S. Cl. ..... 446/330; 446/352; 40/414
(58) Field of Search ..... 446/268, 330, 446/331, 376, 136, 139, 352; 40/411, 414, 415, 418, 420

(56) References Cited

U.S. PATENT DOCUMENTS 3,672,097 A * 6/1972 Gardel et al. ..... 446/352
3,964,205 A * 6/1976 Kuramochi ..... 46/120
4,723,932 A * 2/1988 Kelley et al. ..... 446/330
4,944,708 A * 7/1990 Kawabe ..... 446/175
5,147,238 A * 9/1992 Kelley et al. ..... 446/330
5,176,560 A * 1/1993 Wetherell et al. ..... 446/175
5,442,869 A * 8/1995 McDarren et al. ..... 40/406
5,789,043 A * 8/1998 Law et al. ..... 428/10
5,911,617 A * 6/1999 Chou ..... 446/353
5,941,756 A * 8/1999 Chou ..... 446/330
6,062,938 A * 5/2000 Meng-Suen ..... 446/134
6,071,170 A * 6/2000 How ..... 446/330
6,126,508 A * 10/2000 Chou ..... 446/358
6,282,820 B1 * 9/2001 White et al. ..... 40/410

* cited by examiner

*Primary Examiner*—Jacob K. Ackun
(74) *Attorney, Agent, or Firm*—Stetina Brunda Garred & Brucker

(57) ABSTRACT

An animated toy comprising a toy body which itself includes at least one shoulder member and a pair of waist members, the upper ends of which are pivotally connected to the shoulder member. The toy body further includes a pair of leg members having upper ends which are pivotally connected to the lower ends of respective ones of the waist members. The lower ends of the leg members are pivotally connected to a support base. In addition to the toy body, the animated toy comprises a drive unit mounted to the support base and including a reversible motor which is mechanically coupled to at least one of the leg members and operative to reciprocally tilt the leg members in first and second directions. The toy body is configured such that the tilting of the leg members in the first direction causes the waist members to be tilted in the second direction, with the tilting of the leg members in the second direction causing the waist members to be tilted in the first direction.

38 Claims, 11 Drawing Sheets

ANIMATED TOY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to motion toys, and more particularly to an animated toy comprising a plurality of structural elements pivotally connected to each other in a manner defining a human body, and a reversible motor which is disposed externally of the body and cooperatively engaged to the structural elements thereof so as to be operative to cause portions of the body defined by the structural elements to alternatively tilt or sway in different directions.

There is currently known in the prior art a wide variety of animated or motion toys which employ the use of one or more motors and associated transmission gear trains to facilitate the movement of various parts of the toy. These animated toys include figurines which have the shape of a human body, with the motor(s) and gear train(s) thereof being operative to cause various parts of the body, such as the arms, legs and/or head, to move separately and/or in unison.

One such animated or motion toy currently known in the prior art is disclosed in U.S. Pat. No. 5,911,617 issued on Jun. 15, 1999 to Chou. The motion toy disclosed in the Chou patent differs from those known in the prior art by,among other things, the capability of the upper and lower parts of the body thereof to alternatively tilt inwardly and outwardly and reverse directions. To achieve this particular range of motion, the motion toy disclosed in the Chou patent comprises a pair of waist cover shells, the upper ends of which are pivotally connected to respective ones of a pair of shoulder cover shells, with the lower ends of the waist cover shells being pivotally connected to respective ones of a pair of foot cover shells. Also included in the motion toy is a pair of trunk cover shells which are connected to respective ones of the shoulder cover shells and a motor mount which is mounted within a cavity collectively defined by the waist, shoulder and trunk cover shells. A reversible motor is attached to the motor mount and disposed between the trunk cover shells, with the motor being mechanically coupled to the foot cover shells via a pair of main racks which are integrally formed on respective ones of the foot cover shells.

Though the body of the motion toy disclosed in the Chou patent is configured in a manner wherein the upper and lower parts thereof alternatively tilt inwardly and outwardly in reverse directions, the motion toy is of a relatively large size due to the inclusion of the drive unit within the interior of the body (i.e., between the trunk cover shells). Due to this relatively large size, the motion toy is not well suited to being mounted to a decorative/ornamental item such as, for example, a holiday wreath. Due to the inclusion of the drive unit within the interior of the body, the motion toy disclosed in the Chou patent is also not well suited to being used in an aqueous environment, such as within the interior of a decorative water ball. Additionally, the motion toy disclosed in the Chou patent is devoid of any structures which provide for the movement of the arms and head of the toy which are attached to the shoulder cover shells thereof. As will be recognized, such movement of the arms and/or head would provide a more life-like, appealing appearance during the operation of the motion toy.

The present invention provides an animated or motion toy similar in structure and operation to that disclosed in the Chou patent, but significantly differing in that the drive unit or reversible motor of the present motion toy is external of the body as opposed to being disposed within the interior thereof. Making the drive unit external to the body allows for the manufacture of the motion toy of the present invention in a size substantially less than that of the motion toy disclosed in the Chou patent, thus allowing for the mounting of the present motion toy to decorative/ornamental items such as a holiday wreath. With particular regard to a holiday wreath, the drive unit or motor of the present motion toy may be embedded within the wreath itself, with the body of the motion toy extending into the open interior thereof to provide a decorative holiday item wherein the ornamental attributes of the wreath are enhanced by the body (e.g., a Santa Claus).

Additionally, the motion toy of the present invention is preferably provided with an internal linkage arrangement which facilitates the alternating upward and downward movement of the arms attached to the shoulder member of the body thereof. This linkage arrangement also provides for the rotation of the head attached to the shoulder member in a back and forth motion. Moreover, due to the drive unit not being disposed therewithin, the body of the present motion toy may itself be disposed and operated within an aqueous environment. In this instance, the drive unit would not itself be disposed within such aqueous environment, but rather would cooperate with the body either through a mechanical linkage or magnets. These and other unique attributes of the present invention will be discussed in more detail below.

BRIEF SUMMARY OF THE INVENTION

In accordance with the present invention, there is provided an animated toy comprising a toy body which itself comprises at least one shoulder member and a pair of waist members, the upper ends of which are pivotally connected to the shoulder member. The toy body also includes a pair of leg members, with the lower ends of the waist members being pivotally connected to the upper ends of respective ones of the leg members. In addition to the toy body, the animated toy of the present invention comprises a support base to which the lower ends of the leg members are pivotally connected. Also included in the animated toy is a drive unit which is disposed adjacent to the support base and includes a motor which is cooperatively engaged to at least one of the leg members and operative to reciprocally tilt the leg members in first and second directions. The toy body of the present animated toy is configured such that the tilting of the leg members in the first direction causes the waist members to be tilted in the second direction, with the tilting of the leg members in the second direction causing the waist members to be tilted in the first direction.

The toy body of the animated toy further preferably comprises a pair of arm members which are rotatably connected to the shoulder member and mechanically coupled to the upper ends of respective ones of the waist members, so as to be alternately movable in different directions thereby. More particularly, the arm members are mechanically coupled to the waist members such that the tilting of the waist members in the first and second directions causes the arm members to alternately move in different directions. To facilitate such coupling, each of the waist members preferably includes a waist rack portion which defines the upper end thereof. Additionally, each of the arm members preferably includes a pinion gear portion which protrudes therefrom and is cooperatively engaged to a respective one of the waist rack portions. The tilting of the waist members in the first and second directions causes the waist rack portions to act against the pinion gear portions in a manner facilitating the alternate rotation of the arm members in opposite directions.

The toy body of the present invention further comprises a head member which is rotatably connected to the shoulder member and mechanically coupled to the waist members such that the tilting of the waist members in the first and second directions causes the head member to alternately rotate in different directions. To facilitate such rotation, the toy body further preferably comprises an upper support strut which is pivotally connected to and extends between the waist members such that the tilting of the leg members in the first direction causes the upper support strut to be tilted in the second direction, and the tilting of the leg members in the second direction causes the upper support strut to be tilted in the first direction. The upper support strut includes a pair of cam levers protruding therefrom in spaced relation to each other. Additionally, the head member defines a central axis and includes a head pin protruding therefrom in radially offset relation to the central axis. The head pin extends between the cam levers such that the tilting of the upper support strut in the first and second directions causes the cam levers to act against the head pin in a manner facilitating the alternate rotation of the head member in opposite directions.

Also preferably included in the toy body of the present animated toy is a lower support strut which is pivotally connected to and extends between the upper ends of the leg members, and hence the lower ends of the waist members. The toy body further preferably comprises at least one trunk plate attached to the shoulder member, and more particularly a back trunk plate which is attached to the shoulder member and the lower support strut, and a front trunk plate which is attached to the shoulder member and the back trunk plate.

The toy body of the present animated toy defines opposite sides, with the leg member extending along one side of the toy body preferably being mechanically coupled to the waist member extending along the other side thereof. In accordance with a first embodiment of the present invention, the lower end of one of the waist members includes a first tilt rack portion formed thereon or attached thereto, with the upper end of one of the leg members including a second tilt rack portion formed thereon or attached thereto which is cooperatively engaged to the first tilt rack portion, and more particularly directly intermeshed thereto. The drive unit of the animated toy of the first embodiment is preferably mechanically coupled to the leg member having the second tilt rack portion formed thereon. In accordance with a second embodiment of the present invention, the first and second tilt rack portions are not directly intermeshed with each other. Rather, the toy body further comprises a drive strut which is pivotally connected to and extends between the upper ends of the leg members, and hence the lower ends of the waist members. Rotatably connected to the direct strut is a pair of identically configured drive gears which are cooperatively engaged (i.e., directly intermeshed) to each other. The first and second tilt rack portions in the second embodiment are cooperatively engaged to respective ones of the drive gears. In accordance with a third embodiment of the present animated toy, the lower end of one of the waist members includes a drive slot formed therein, with the upper end of the one of the leg members including a drive pin protruding therefrom which is movably received into the drive slot. In the animated toy of the third embodiment, the drive unit is preferably mechanically coupled to a leg member having the drive pin protruding therefrom.

As indicated above, the drive unit of the present animated toy is cooperatively engaged to at least one of the leg members of the toy body. To facilitate such engagement, the lower end of one of the leg members preferably includes a main drive rack portion formed thereon or attached thereto. Additionally, the motor of the drive unit is preferably reversible, and includes a main drive gear mechanically coupled thereto which is cooperatively engaged to the main drive rack portion such that the rotation of the main drive gear in a first direction facilitates the tilting of the leg members in the first direction, with the rotation of the main drive gear in a second direction opposite the first direction facilitating the tilting of the leg members in the second direction. The main drive rack portion is preferably formed on the lower end of that leg member having the second tilt rack portion or pivot pin formed on the opposite, upper end thereof. In the present animated toy, the drive unit is preferably mounted to the support base, with the reversible motor being disposed within the support base and the lower end of the leg member having the main drive rack portion formed thereon extending into the support base. The support base itself is preferably formed to include a pair of foot portions thereon, with the lower ends of the leg members being pivotally connected to respective ones of the foot portions. It is contemplated that the above-described animated toy may be used in combination with a decorative annular wreath defining an open interior region, with the support base being mounted to the wreath such that the toy body extends into the interior region thereof.

The animated toy of the present invention may be alternatively configured for use in an aqueous environment. In this modified version of the present animated toy, the lower end of one of the leg members preferably includes at least one leg magnet attached thereto or disposed therein as an alternative to being formed to include the above-described main drive rack portion. The motor of the drive unit is mechanically coupled to at least one drive magnet of the drive unit in a manner wherein the motor is operative to reciprocally move the drive magnet in a first magnet path and a second magnet path opposite the first magnet path. The first and second magnet paths are preferably arcuate. The drive magnet magnetically cooperates with the leg magnet such that the movement of the drive magnet along the first magnet path facilitates the tilting of the leg members in the first direction, with the movement of the drive magnet along the second magnet path facilitating the tilting of the leg members in the second direction. This modified version of the present animated toy is preferably used in combination with a hollow enclosure (e.g., a spherically shaped water ball), with the support base and the toy body being partially disposed within the enclosure and the drive unit being disposed exteriorly of the enclosure. Though a portion of the support base separates the leg magnet from the drive magnet, they are disposed sufficiently close to each other such that the drive magnet is able to magnetically engage the leg magnet. It is contemplated that each of the leg members may include a leg magnet attached to or disposed within the lower end thereof, with the motor of the drive unit being mechanically coupled to a pair of drive magnets which are simultaneously reciprocally movable in the first and second magnet paths and magnetically cooperate with respective ones of the leg magnets.

In accordance with a fifth embodiment of the present invention, there is provided an animated toy comprising a toy body which itself comprises at least one shoulder member and an upper support strut which is pivotally connected to the shoulder member. Also included in the toy body is a pair of waist members, the upper ends of which are pivotally connected to the upper support strut. The toy body further comprises a pair of leg members, with the lower ends of the waist members being pivotally connected to the upper ends of respective ones of the leg members. In addition to the toy body, the animated toy of the fifth embodiment comprises a support base to which the lower ends of the leg members are pivotally connected. Also included in the animated toy of the fifth embodiment is a drive unit which is disposed adjacent to the support base and includes a motor which is cooperatively engaged to at least one of the leg members and operative to reciprocally tilt the leg members in first and second directions. The tilting of the leg members in the first direction causes the waist members to be tilted in the second direction, with the tilting of the leg members in the second direction causing the waist members to be tilted in the first direction.

In addition to the above-described components, the toy body of the fifth embodiment comprises a lower support strut which is pivotally connected to and extends between the upper ends of the leg members, a back trunk plate which is pivotally connected to the upper and lower support struts, and a front trunk plate which is pivotally connected to the shoulder member and the back trunk plate. A cam member is also included in a toy body which is attached. to the front trunk plate and movable therewith. In the animated toy of the fifth embodiment, the tilting of the leg members in the first direction causes the front and back trunk plates, and hence the cam member, to be tilted in the second direction, with the tilting of the leg members in the second direction causing the front and back trunk plates, and hence the cam member, to be tilted in the first direction.

The toy body of the animated toy of the fifth embodiment also includes a pair of arm members which are rotatably connected to the shoulder member and mechanically coupled to the cam member so as to be alternately movable in different directions thereby. More particularly, the arm members are mechanically coupled to the cam member such. that the tilting of the cam member in the first and second directions causes the arm members to alternately move in different directions. Also rotatably connected to the shoulder member is a head member of the toy body which is itself mechanically coupled to the cam member such that the tilting of the cam member in the first and second directions causes the head member to alternately rotate in different directions. The cam member preferably includes a central pair of cam levers and two outer pairs of cam levers which protrude from a common side thereof. Each of the arm members preferably includes an arm pin which protrudes therefrom, with the head member defining a central axis and including a head pin protruding therefrom in radially off-set relation to the central axis. The arm pin of each of the arm members extends between a respective outer pair of cam levers such that the tilting of the cam member in the first and second directions causes the outer pairs of cam levers to act against the arm pins in a manner facilitating the alternate rotation of the arm members in opposite directions. Similarly, the head pin extends between the central pair of cam levers such that the tilting of the cam member in the first and second directions causes the central pair of cam levers to act against the head pin in a manner facilitating the alternate rotation of the head member in opposite directions.

The toy body of the animated toy of the fifth embodiment defines opposite sides, with the leg member extending along one side of the toy body being mechanically coupled to the waist member extending along the other side thereof. In the fifth embodiment, the lower end of one of the waist members includes a first tilt rack portion formed thereon or attached thereto, with the upper end of one of the leg members including a second tilt rack portion formed thereon or attached thereto which is cooperatively engaged to the first tilt rack portion, and more particularly directly intermeshed thereto. The drive unit of the animated toy of the fifth embodiment is preferably mechanically coupled to the leg member having the second tilt rack portion formed thereon.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
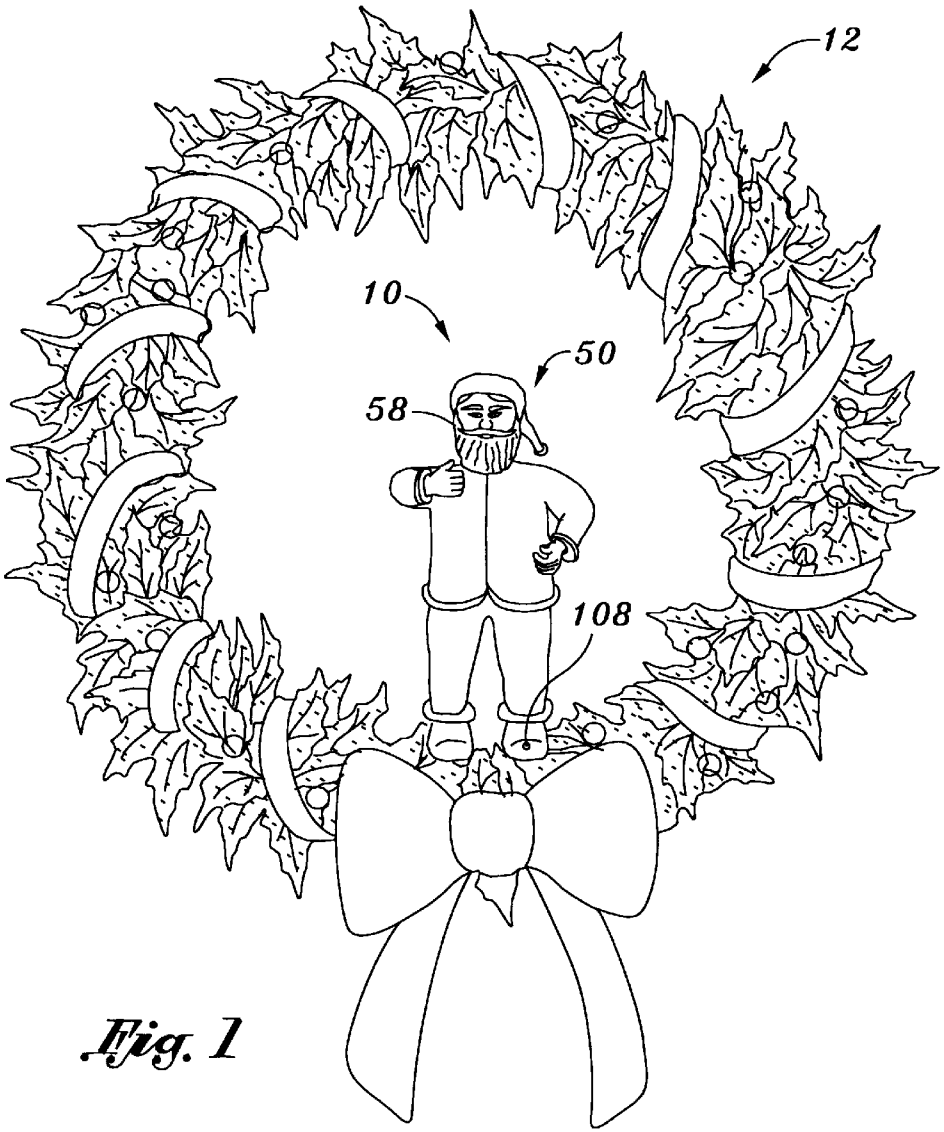
FIG. 1 is a front elevational view of an animated toy constructed in accordance with a first embodiment of the present invention as disposed within the interior of a decorative wreath.

Referring now to the drawings wherein the showings are for purposes of illustrating preferred embodiments of the present invention only, and not for purposes of limiting the same, FIG. 1 provides a front elevational view of an animated toy 10 constructed in accordance with a first embodiment of the present invention. As seen in FIG. 1, the animated toy 10 has a configuration of a human being, and more particularly Santa Claus. As will be discussed in more detail below, the animated toy 10 includes a head, torso, arms, legs and feet. Though being provided in the form of a human body, those of ordinary skill in the art will recognize that the animated toy 10 need not necessarily resemble Santa Claus. In FIG. 1, the animated toy 10 of the first embodiment is depicted as being mounted to an annular holiday wreath 12 in a manner wherein the animated toy 10 extends into the open interior thereof. It will further be recognized that the animated toy 10 need not necessarily be mounted to the wreath 12, and that the animated toy 10 may further be mounted to decorative/ornamental items other than for wreaths. For example, if the animated toy 10 were to resemble a ghost or skeleton for a Halloween theme as opposed to resembling Santa Claus for a Christmas theme, such animated toy 10 could be mounted to a decorative/ornamental item such as a tombstone or castle.

Referring now to FIGS. 2–5, the animated toy 10 comprises a toy body 14 which itself comprises a shoulder member 16. In the first embodiment, the shoulder member 16 includes a front shoulder section 18 and a back shoulder section 20 which are rigidly attached to each other via fasteners such as screws. In addition to the shoulder member 16, the toy body 14 includes a pair of waist members 22, each of which defines an upper end 24 and a lower end 26. The upper ends 24 of the waist members 22 are pivotally connected to the shoulder member 16 via fasteners such as a pair of pivot pins 28. The upper ends 24 of the waist members 22 are inserted between the front and back shoulder sections 18, 20, and more particularly into a cavity collectively defined thereby. Each pivot pin 28 is advanced through a respective upper end 24, with the opposed ends of such pivot pin 28 being received into a corresponding pair of tubular bosses formed on respective ones of the front and back shoulder sections 18, 20.

Figure 5:
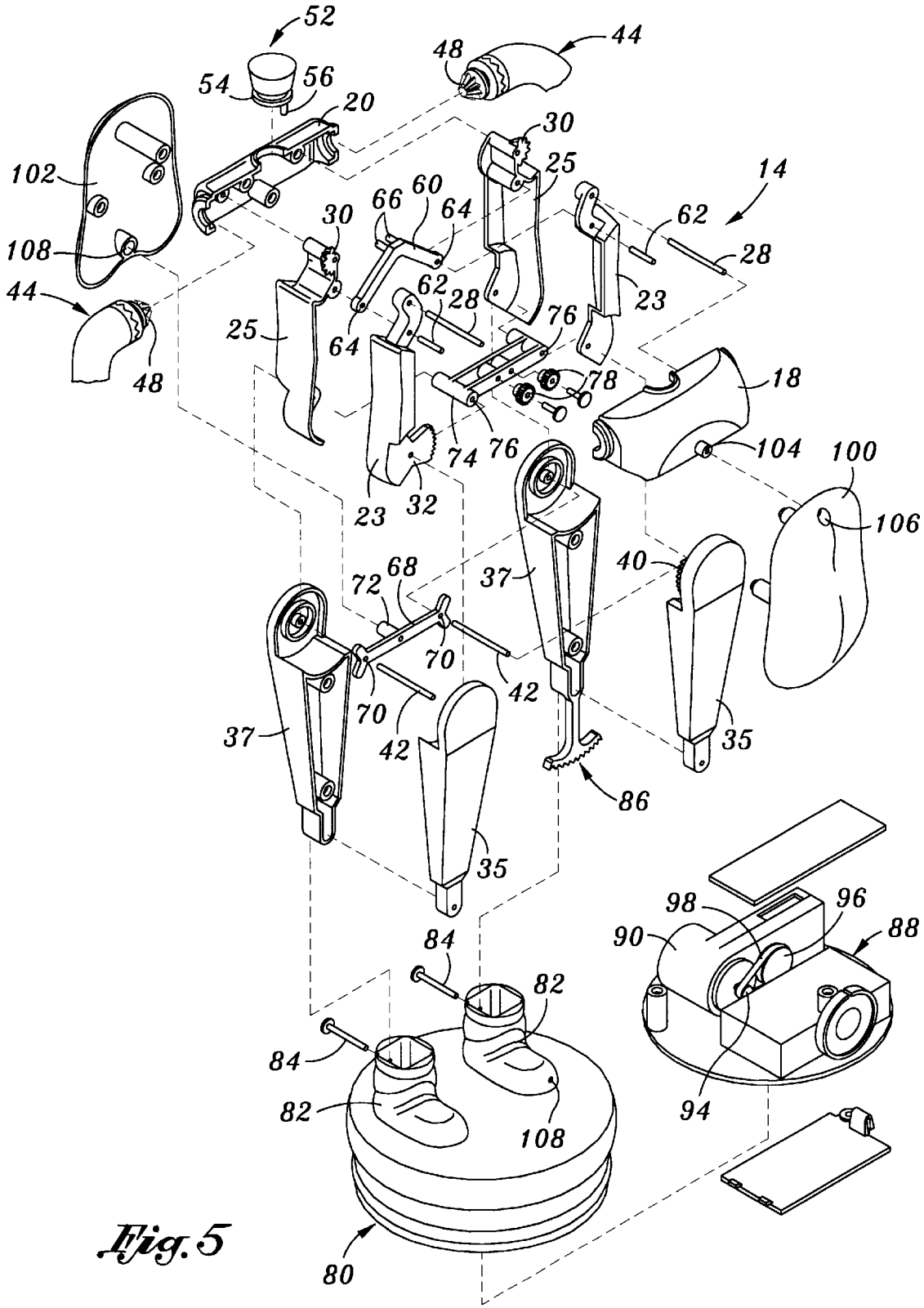
FIG. 5 is an exploded view of the animated toy of the first embodiment, illustrating various components thereof.

As is best seen in FIG. 5, the waist members 22 are preferably not unitary structures, but rather each comprise front and back waist sections 23, 25 which are rigidly attached to each other via fasteners such as screws. In the first embodiment, formed on the upper end 24 of each waist member 22 is a waist rack portion 30. More particularly, each waist rack portion 30 is formed on the back waist section 25 of a respective one of the waist members 22. The use of the waist rack portion 30 of each waist member 22 will be discussed in more detail below.

Figure 3:
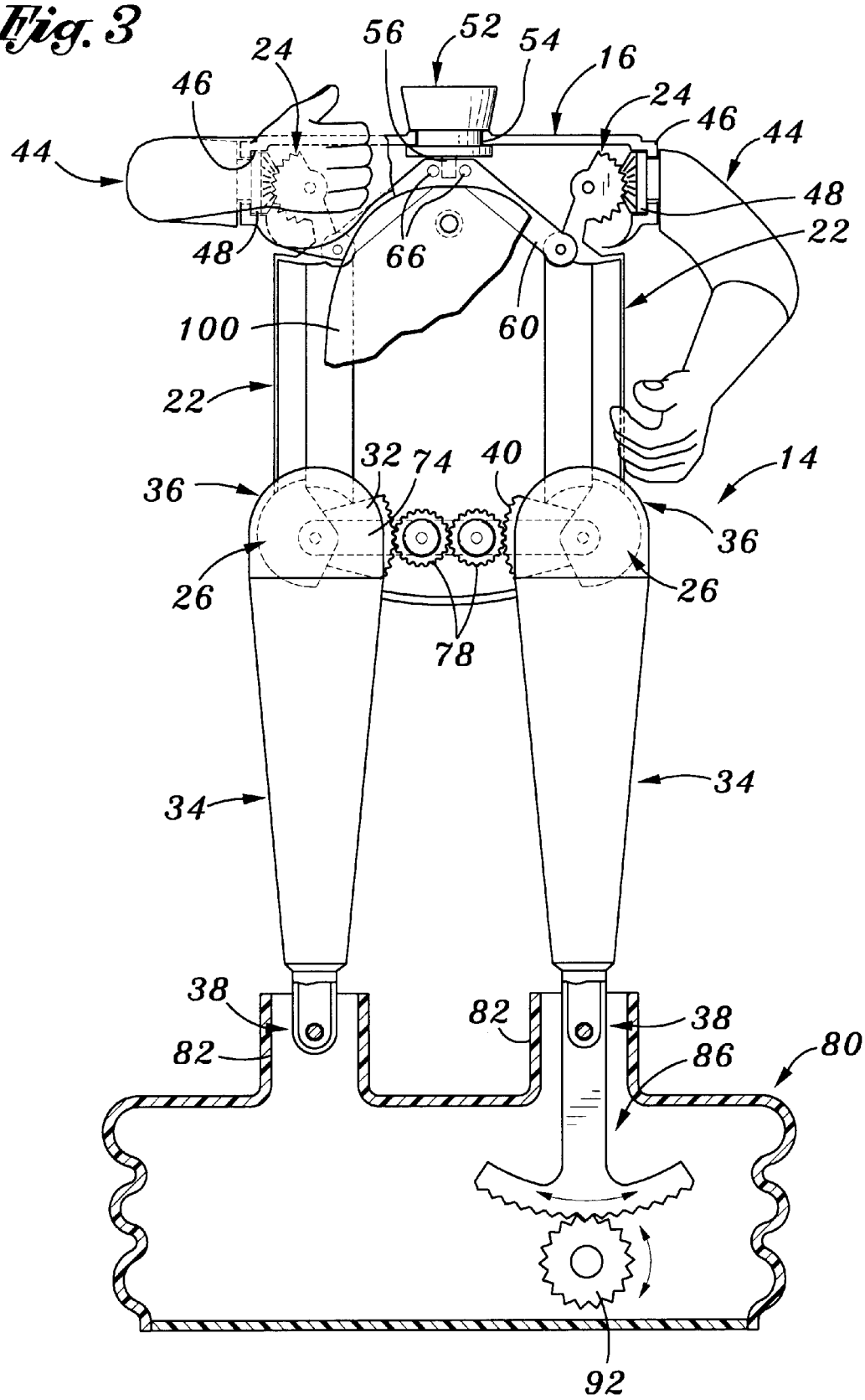
FIG. 3 is a front elevational view of the animated toy of the first embodiment excluding the front and back trunk plates.

As is seen in FIGS. 3–5, in the animated toy 10 of the first embodiment, the lower end 26 of one of the waist members 22 (i.e., the left waist member 22 as viewed from the front of the animated toy 10) includes an integrally formed first tilt rack portion 32 extending inwardly therefrom. More particularly, the first tilt rack portion 32 is formed on the front waist section 23 of the waist member 22. The use of the first tilt rack portion 32 will also be discussed in more detail below.

The toy body 14 of the animated toy 10 of the first embodiment further comprises a pair of leg members 34, each of which defines an upper end 36 and a lower end 38. As is further seen in FIG. 5, the leg members 34 are also preferably not unitary structures, but rather each comprise front and back leg sections 35, 37 which are rigidly attached to each other via fasteners such as screws. Integrally formed on and extending inwardly from the upper end 36 of one of the leg members 34 (i.e., the right leg member 34 as viewed from the front of the animated toy 10) is a second tilt rack portion 40, the use of which will be discussed in more detail below. More particularly, the second tilt rack portion 40 is formed on the front leg section 35 of the leg member 34. The first and second tilt rack portions 32, 40 are formed to extend inwardly from opposite sides of the toy body 14. Thus, it will be recognized that the toy body 14 may alternatively be formed such that the first tilt rack portion 32 is formed on the lower end of the right waist member 22, with the second tilt rack portion 40 being formed on the upper end 36 of the left leg member 34.

Figure 2:
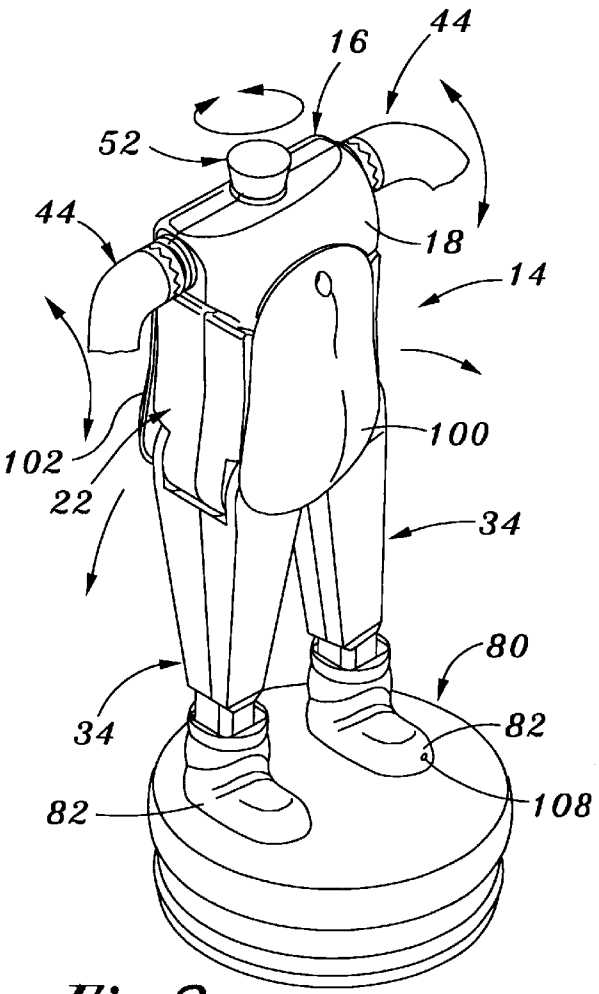
FIG. 2 is a front perspective view of the animated toy of the first embodiment.

In the animated toy 10 of the first embodiment, the upper ends 36 of the leg members 34 are pivotally connected to the lower ends 26 of respective ones of the waist members 22 via a pair of fasteners such as pivot pins 42. More particularly, as is best seen in FIGS. 2 and 5, the lower end 26 of each waist member 22 is inserted between a pair of ear portions defined at the upper end 36 of a respective leg member 34. One of these ear portions is formed on the front leg section 34*a* of the leg member 34, with the other ear portion being formed on the back leg section 34*b* thereof. A pivot pin 42 is advanced through the lower end 26, with the opposed ends of the pivot pin 42 being received into and supported by a pair of tubular bosses formed on respective ones of the ear portions defining the corresponding upper end 36.

The toy body 14 of the animated toy 10 of the first embodiment further comprises a pair of arm members 44 which are rotatably connected to respective ones of the opposed ends of the shoulder member 16 in the manner shown in FIGS. 3–5. More particularly, each of the arm members 44 define a continuous groove or channel 46 which extends thereabout in close proximity to the end thereof opposite the end formed to include the fingers. The channel 46 of each arm member 44 is sized and configured to receive a complimentary, continuous annular lip collectively defined by the front and back shoulder sections 18, 20 of the shoulder member 16, with the receipt of such lip into the channel 46 facilitating the rotatable attachment of the arm member 44 to the shoulder member 16. As will be recognized, to facilitate the receipt of each of the annular lips of the shoulder member 16 into a respective channel 46, the arm members 44 are positioned between the front and back shoulder sections 18, 20 in a prescribed manner prior to the rigid attachment thereof to each other.

Each of the arm members 44 further includes a pinion gear portion 48 formed on the end thereof disposed closest to the channel 46. When the arm members 44 are rotatably connected to the shoulder member 16 in the above-described manner, the pinion gear portions 48 thereof are cooperatively engaged to (i.e., intermeshed with) respective ones of the waist rack portions 30 of the waist members 22. The cooperative engagement of the pinion gear portions 48 to the waist rack portions 30 facilitates the alternating upward and downward movement of the arm members 44 as will be discussed in more detail below.

Also rotatably connected to the shoulder member 16 is a head member 50 of the toy body 14. The head member 50 includes a stem section 52 which is itself rotatably connected to the shoulder member 16. More particularly, as is best seen in FIGS. 3–5, the stem section 52 defines a continuous groove or channel 54 which extends thereabout and is sized and configured to receive a complimentary annular edge collectively defined by the front and back shoulder sections 18, 20. This annular edge defines the periphery of a circular opening formed within the top of the shoulder member 16. The stem section 52 defines a central axis and, when rotatably connected to the shoulder member 16, is adapted to rotate about the central axis. Protruding from that end of the stem section 52 disposed closest to the channel 54 is a head pin 56. In the toy body 14, the head pin 56 is not coaxially aligned with the central axis of the stem section 52, but rather extends from the end of the stem section 52 in radially off-set relation to the central axis for reasons which will be described in more detail below. As such, the head pin 56, like the pinion gear portions 48, resides within the interior of the shoulder member 16. The head pin 56 protruding from the stem section 52 facilitates the rotation of the head member 50 in a manner which will also be described in more detail below. In addition to the stem section 52, the head member 50 includes a decorative outer section 58 which is attached to the exposed end of the stem section 52.

The toy body 14 of the animated toy 10 of the first embodiment further comprises an angled upper support strut 60 having opposed ends which are pivotally connected to the upper ends 24 of respective ones of the waist members 22. As is best seen in FIG. 5, such pivotal connection is facilitated by a pair of fasteners such as pivot pins 62 which are advanced through a corresponding pair of apertures 64 disposed within respective ones of the opposed ends of the upper support strut 60. Each of the opposed ends of the upper support strut 60 is positioned between the front and back waist sections 23, 25 of a respective one of the waist members 22, with the opposed ends of each pivot pin 62 being received into a pair of apertures disposed within respective ones of the front and back waist sections 23, 25 of the corresponding waist member 22. Protruding from a common side of the apex of the upper support strut 60 in spaced, generally parallel relation to each other is a pair of cam levers 66. As is best seen in FIGS. 3 and 4, when the stem section 52 of the head member 50 is rotatably connected to the shoulder member 16, the head pin 56 is advanced between the cam levers 66 of the upper support strut 60. As will be discussed below, the cam levers 66 act against the head pin 56 in a manner which facilitates the alternate rotation of the head member 50.

As is further seen in FIG. 5, the toy body 14 of the animated toy 10 of the first embodiment further preferably comprises a lower support strut 68 having opposed ends which are pivotally connected to those pivot pins 42 used to facilitate the pivotal connection of the upper ends 36 of the leg members 34 to the lower ends 26 of respective ones of the waist members 22. As such, the lower support strut 68 extends between the lower ends 26 of the waist members 22, as well as the upper ends 36 of the leg members 34. The pivot pins 42 used to pivotally connect the waist members 22 to the leg members 34 are advanced through a corresponding pair of apertures 70 disposed within respective ones of the opposed ends of the lower support strut 68. Protruding from the approximate center of one side of the lower support 68 is a cylindrically configured boss 72, the use of which will be discussed in more detail below.

As is further seen in FIGS. 3–5, the toy body 14 of the animated toy 10 of the first embodiment further comprises a drive strut 74 which, like the lower support strut 68, has opposed ends which are pivotally connected to those pivot pins 42 used to facilitate the pivotal connection of the upper ends 36 of the leg members 34 to the lower ends 26 of respective ones of the waist members 22. As such, the drive strut 74 also extends between the lower ends 26 of the waist members 22, as well as the upper ends 36 of the leg members 34. The pivot pins 42 used to pivotally connect the waist members 22 to the leg members 34 are advanced through a corresponding pair of apertures 76 disposed within respective ones of the opposed ends of the drive strut 74.

Rotatably connected to a common side of the drive strut 74 is an identically configured pair of drive gears 78 which are cooperatively engaged to (i.e., intermeshed with) each other. When the toy body 14 is properly assembled, the left drive gear 78 as observed from the front of the animated toy 10 is cooperatively engaged to the first tilt rack portion 32 of the left waist member 22. The right drive gear 78 is itself cooperatively engaged to the second tilt rack portion 40 of the right leg member 34.

Referring now to FIGS. 2–5, the animated toy 10 of the first embodiment further comprises a support base 80 which, as seen in FIGS. 2 and 5, includes an integrally formed, spaced pair of foot portions 82. In the animated toy 10, the lower ends 38 of the leg members 34 are pivotally connected to respective ones of the foot portions 82 of the support base 80 through the use of fasteners such as pivot pins 84.

As is seen in FIGS. 3–5, the lower portions of the leg members 34 of the toy body 14 are not identically configured. Rather, the right leg member 34 (as viewed from the front of the animated toy 10) which includes the second tilt rack portion 40 formed thereon also includes a generally T-shaped main drive rack portion 86 integrally connected to and extending downwardly from its lower end 38. Thus, as is best seen in FIGS. 3 and 4, the main drive rack portion 86 extends into the hollow interior of the support base 80. Those of ordinary skill in the art will recognize that rather than being integrally formed on the lower end 38 of the right leg member 34, the main drive rack portion 86 may alternatively comprise a separate component which is rigidly attached to the lower end 38. Additionally, though the main drive rack portion 86 is shown in FIGS. 3 and 5 as being formed on the lower end 38 of the right leg member 34, it may alternatively be formed to extend from the lower end 38 of the left leg member 34.

Disposed within the hollow interior of the support base 80 is a drive unit 88 of the present animated toy 10. The drive unit 88 includes a reversible motor 90 which is cooperatively engaged (i.e., mechanically coupled) to a main drive gear 92 via a transmission gear train of the drive unit 88. This transmission gear train includes first and second drive pulleys 94, 96 which are coupled to each other via a continuous transmission belt 98, as is shown in FIG. 5. As is seen in FIGS. 3 and 4, the main drive rack portion 86 which extends from the lower end 38 of the right leg member 34 is sized and configured so as to be cooperatively engaged to (i.e., intermeshed with) the main drive gear 92 of the drive unit 88 when the lower ends 38 of the leg members 34 are pivotally connected to the foot portions 82 of the support base 80.

The toy body 14 of the animated toy 10 of the first embodiment further preferably comprises a front trunk plate 100 and a back trunk plate 102 which are attached to each other such that portions of the shoulder member 16 and waist members 22 are sandwiched therebetween. The front trunk plate 100 is cooperatively engaged to the front shoulder section 18 via the receipt of a tubular boss 104 extending forwardly from the front shoulder section 18 into a complimentary opening 106 formed within the front trunk plate 100. The back trunk plate 102 is itself cooperatively engaged to the lower support strut 68 via the receipt of the boss 72 into a complimentary opening 108 formed within the back trunk plate 102.

Figure 4A:
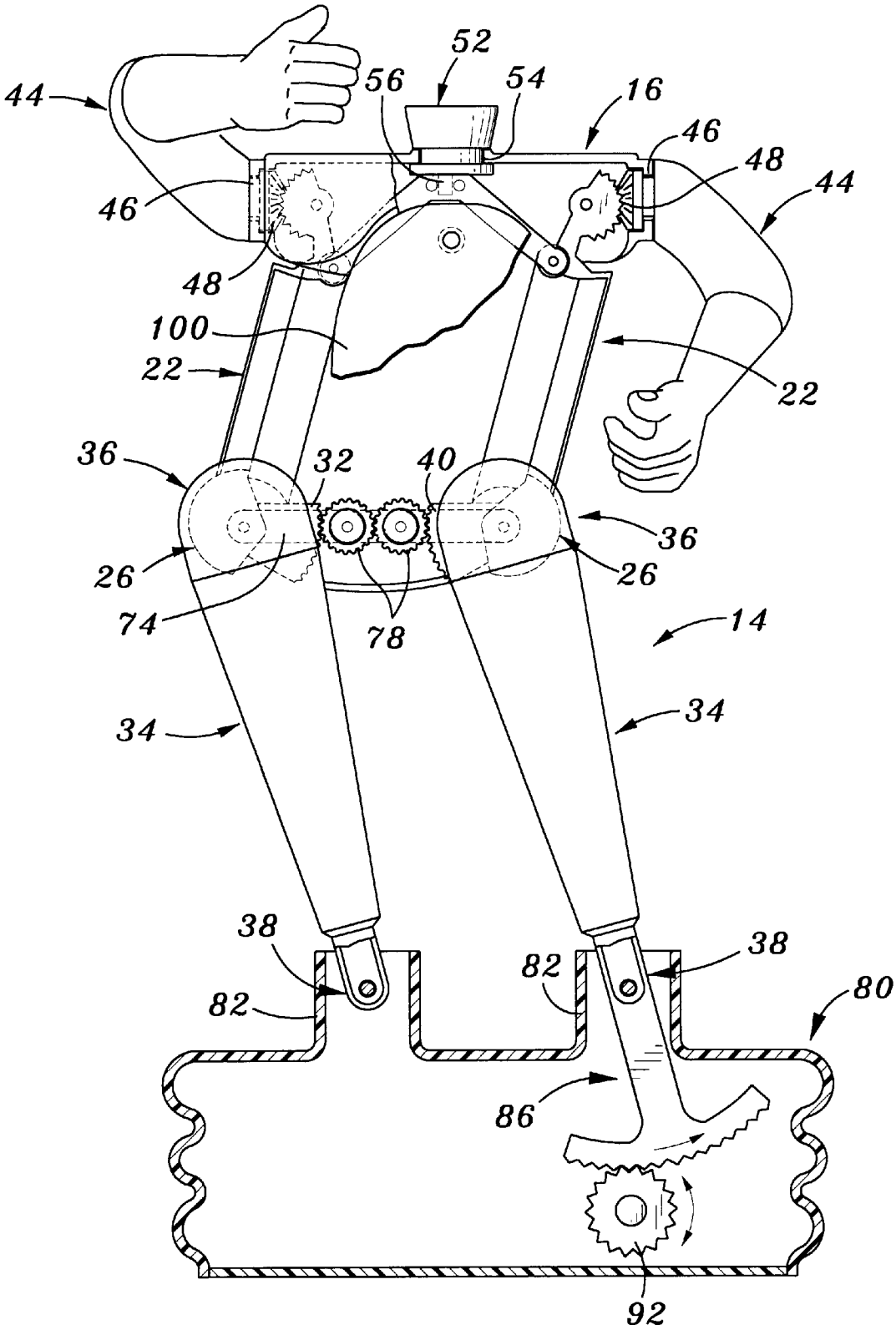
FIG. 4*a* is a front elevational view of the animated toy of the first embodiment similar to that shown in FIG. 3, illustrating one limit of its range of motion.
Figure 4B:
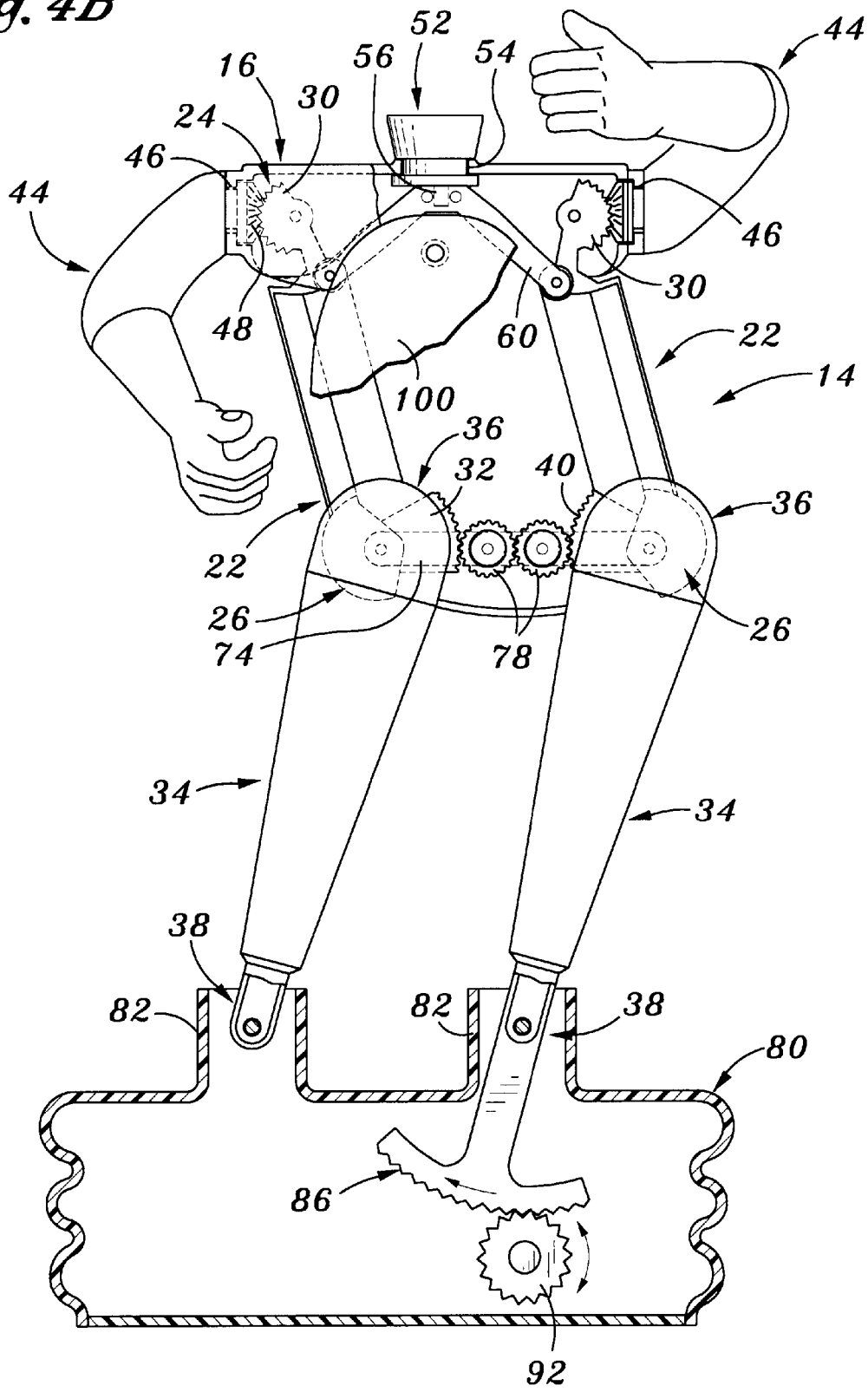
FIG. 4*b* is a front elevational view of the animated toy of the first embodiment similar to that shown in FIG. 4*a*, but illustrating the opposite limit of its range of motion.

In the operation of the animated toy 10 of the first embodiment, the activation of the reversible motor 90 facilitates the rotation of the main drive gear 92 in either a first or second direction. Due to its cooperative engagement to the main drive rack portion 86, the rotation of the main drive gear 92 in a first (i.e., clockwise) direction as viewed from the front of the animated toy 10, results in the first and second leg members 34 being concurrently tilted in a first direction (i.e., to the left) as shown in FIG. 4*a*. Conversely, the rotation of the main drive gear 92 in a second (i.e., counterclockwise) direction as viewed from the front of the animated toy 10, results in the concurrent tilting of the leg members 34 in a second direction (i.e., to the right) as shown in FIG. 4*b*. As will be recognized, the direction of the rotation of the main drive gear 92 is dictated by the direction of rotation of the drive shaft extending from the reversible motor 90 of the drive unit 88.

Due to the cooperative engagement of the drive gears 78 to each other and the cooperative engagement of the drive gears 78 to respective ones of the first and second tilt rack portion 32, 40, the movement or tilting of the leg members 34 in unison in the first direction (to the left) results in the concurrent or simultaneous movement or tilting of the waist members 22 in the second direction (to the right) as shown in FIG. 4*a*. Conversely, the tilting of the leg members 34 in unison in the second direction (to the right) results in the simultaneous tilting of the waist members 22 in the first direction (to the left) as shown in FIG. 4*b*. Further, due to the pivotal connection of the upper support strut 60 to the waist members 22, the movement or tilting of the leg members 30 in unison in the first direction (to the left) results in the concurrent or simultaneous movement or tilting of the upper support strut 60 in the second direction (to the right). Conversely, the tilting of the leg members 34 in unison in the second direction (to the right) results in the simultaneous tilting of the upper support strut 60 in the first direction (to the left).

As previously explained, the head pin 56 of the head member 50 is extended between the cam levers 60. Due to the head pin 56 being radially off-set from the central axis of the stem section 52, the movement or tilting of the upper support strut 60 in the first direction causes the cam levers 66 to act against the head pin 56 in a manner facilitating the rotation of the stem section 52, and hence the head member 50 in a first direction. Conversely, the tilting of the upper support strut 60 in the second direction causes the cam levers 66 to act against the head pin 56 in a manner resulting in the rotation of the head member 50 in a second direction opposite the first direction. Thus, the back and forth movement of the upper support strut 60 in the first and second directions results in the alternate rotation of the head member 50 of the toy body 14 in opposite directions.

Similarly, due to the cooperative engagement of the pinion gear portions 48 of the arm members 44 to the waist rack portions 30 of respective ones of the waist members 22, the tilting of the waist members 22 in the first and second directions results in the simultaneous rotation of the arm members 44 in opposite directions. For example, as viewed from the front of the animated toy 10 as shown in FIG. 4*a*, the tilting of the waist members 22 in the second direction (to the right) results in the left arm member 44 being rotated upwardly, while the right arm member is simultaneously rotated downwardly. Conversely, the tilting of the waist members 22 in the first direction (to the left) as viewed from the front of the animated toy 10 as shown in FIG. 4*b* results in the left arm member 44 being rotated downwardly while the arm member 44 is simultaneously rotated upwardly. Thus, the tilting of the leg members 34 in the first and second directions results in the alternate rotation of the arm members 44 in opposite directions.

Thus, as is apparent from the foregoing description, the activation of the reversible motor 90 of the drive unit 88 imparts to the toy body 14 of the animated toy 10 various ranges of movement which creates the appearance that the animated toy 10 is dancing. In this respect, the tilting of the waist members 22 and leg members 34 in opposite directions creates the appearance that the animated toy 10 is swinging its hips. The simultaneous movement of the arm members 44 upwardly and downwardly in opposite directions and the simultaneous rotation of the head member 50 in opposite directions completes the overall appearance of dancing. Though not shown, the animated toy 10, and in particular the drive unit 88 thereof, may be provided with electronic circuitry which is specifically configured to sequence or time the tilting of the leg members 34, and hence all of the movements of the toy body 14, with a song transmitted or played from a speaker of the drive unit 88. Such timing or sequencing would create an even more life-like appearance since the various motions or movements of the animated toy 10 are not uniform or consistent throughout the entirety of the song, but rather are in time with the music. The timing of the movements of the toy body 14 to the music would be a function of the intervals at which the direction of rotation of the drive shaft of the reversible motor 90 is reversed, with such changes in rotational direction being controlled or regulated by the electronic circuitry.

In addition to such electronic circuitry being operative to time or sequence the movements of the toy body 14 with a song being played, the electronic circuitry may be provided with a motor speed control unit which allows for the speed or rate of such movements to be selectively increased or decreased. Thus, the speed or rate at which the leg members 34, and hence the waist members 22, are tilted in the first and second directions can be selectively increased or decreased to impart an even more life-like appearance to the animated toy 10 during the operation thereof. Thus, both the timing and speed of the various movements of the toy body 14 can be coordinated with a song and/or spoken dialogue transmitted by the speaker of the drive unit 88. Also preferably included in the electronic circuitry used in conjunction with the animated toy 10 is a sensor or motion detector, a portion of which resides within an opening 109 at the front of one of the foot portions 82 of the support base 80, thus allowing the sensor to sense motion signals emanating from the front of the animated toy 10. A more detailed discussion regarding the electronic circuitry which may be used in conjunction with the animated toy 10 of the present invention is set forth in Applicant's co-pending U.S. application Ser. No. 09/456,973 entitled ANIMATED TOY filed Dec. 7, 1999, the disclosure of which is incorporated herein by reference.

Of the various distinctions between the animated toy 10 of the present invention and that disclosed in the aforementioned co-pending application of Applicant, perhaps the most significant distinction is that in the animated toy 10 of the present invention, the drive unit 88 is not disposed within the interior of the toy body 14, but rather is externalized. When the animated toy 10 is used in conjunction with a decorative/ornamental item such as the wreath 12 shown in FIG. 1, the support base 80, and hence the drive unit 88, may be hidden or buried within the wreath 12. The external drive unit 88 also allows for the placement of the toy body 14 of the animated toy 10 in an aqueous environment, as will discussed in more detail below.

Figure 6:
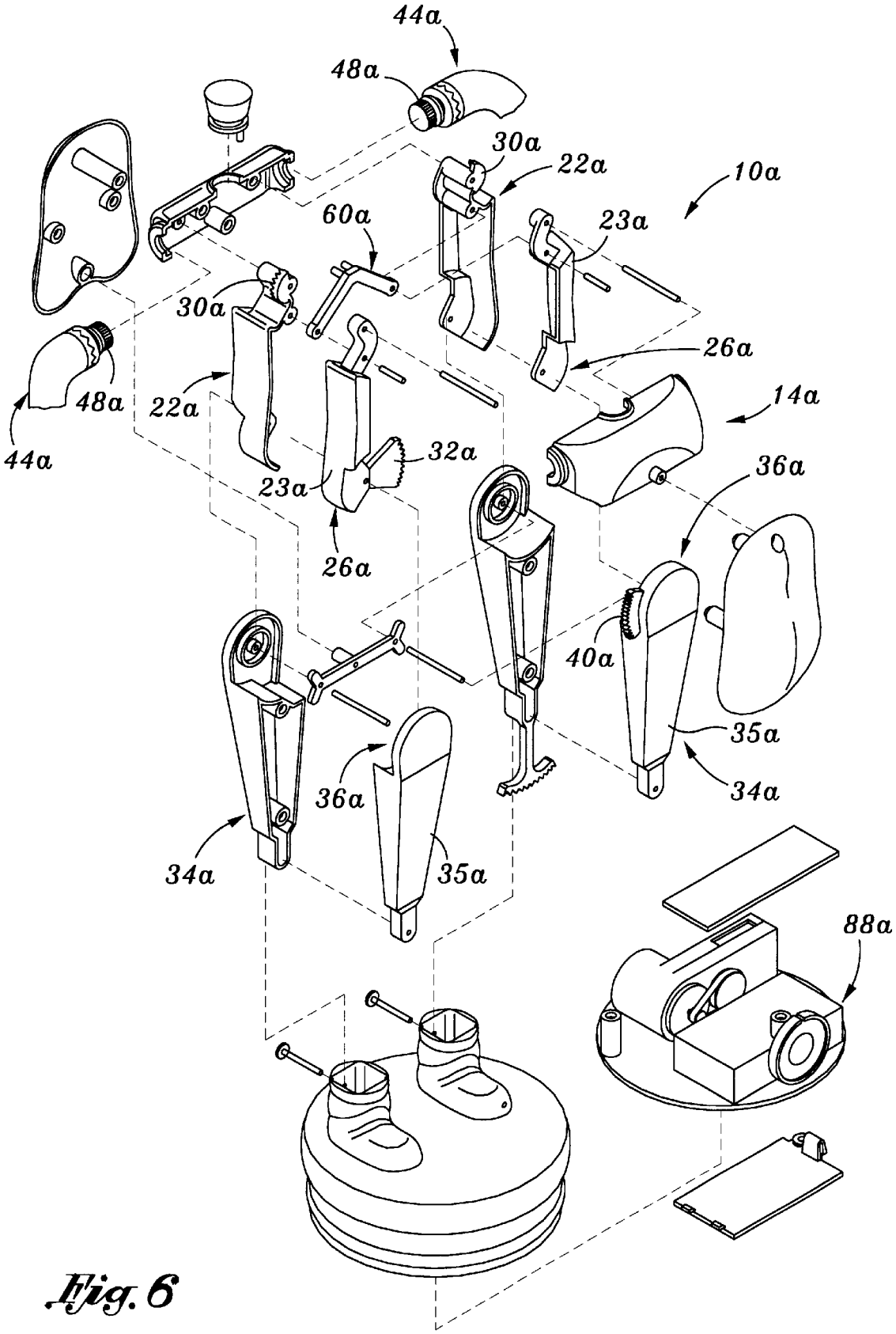
FIG. 6 is an exploded view of an animated toy constructed in accordance with a second embodiment of the present invention, illustrating the various components thereof.

Referring now to FIG. 6, there is depicted an exploded view of an animated toy 10*a* constructed in accordance with a second embodiment of the present invention. The animated toy 10*a* of the second embodiment is substantially similar in structure and function to the above-described animated toy 10 of the first embodiment. Thus, the following discussion regarding the animated toy 10*a* of the second embodiment will be confined only to the particular structural distinctions between the same and the animated toy 10 of the first embodiment.

The primary distinction between the animated toy 10*a* of the second embodiment and the animated toy 10 of the first embodiment is that the drive strut 74 and drive gears 78 are eliminated in the animated toy 10*a*. Additionally, in the animated toy 10*a*, the lower end 26*a* of the left waist member 22*a* (as viewed from the front of the animated toy 10*a*) includes an integrally formed first tilt rack portion 32*a* extending inwardly therefrom which is of a size exceeding that of the first tilt rack portion 32 of the animated toy 10. Thus, the first tilt rack portion 32*a* extends further inwardly than does the first tilt rack portion 32 shown and described above. The first tilt rack portion 32*a* is preferably formed on the front waist section 23*a* of the left waist member 22*a*.

Further, in the animated toy 10*a*, the upper end 36*a* of the right leg member 34*a* (as viewed from the front of the animated toy 10*a*) includes an integrally formed second tilt rack portion 40*a* extending inwardly therefrom. The second tilt rack portion 40*a* is preferably formed on the front leg section 35*a* of the right leg member 34*a*, and is sized so as to protrude inwardly a greater distance than does the above-described second tilt rack portion 40 of the animated toy 10. Thus, in the animated toy 10*a* of the second embodiment, the first tilt rack portion 32*a* is cooperatively engaged (i.e., intermeshed) directly to the second tilt rack portion 40*a*. The cooperative engagement between the first and second tilt rack portions 32*a*, 40*a* causes the leg members 34*a* to interact with the waist members 32*a* in a manner wherein the tilting of the leg members 34*a* in unison in the first direction (to the left) results in the simultaneous tilting of the waist members 22 in the second direction (to the right), with the tilting of the leg members 34*a* in unison in the second direction (to the right) resulting in the simultaneous tilting of the waist members 22*a* in the first direction (to the left) Those of ordinary skill in the art will recognize that the first tilt rack portion 32*a* may alternatively be formed on the lower end 26*a* of the right waist member 22*a*, with the second tilt rack portion 40*a* alternately being formed on the upper end 36*a* of the left leg member 34*a*.

Figure 7:
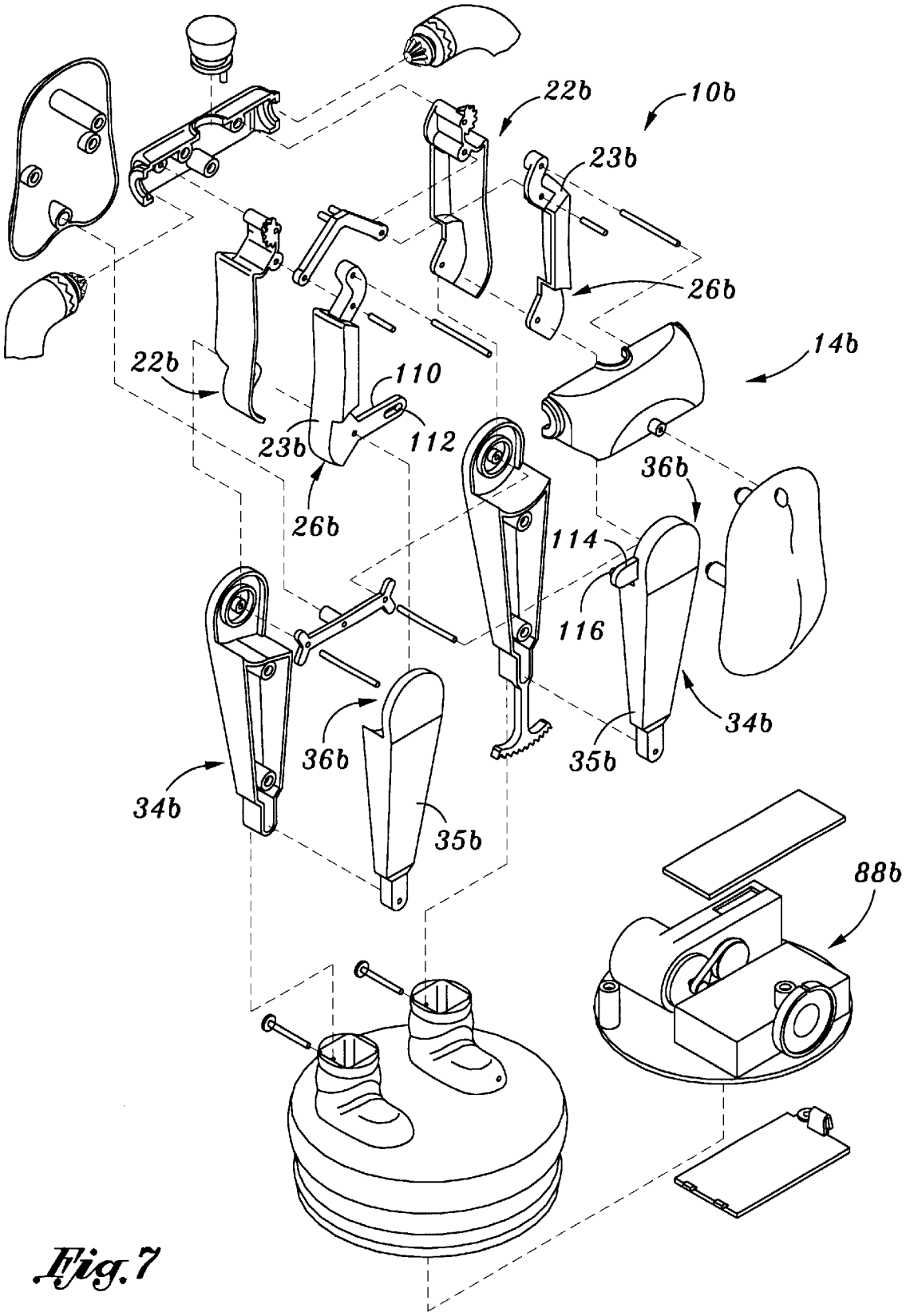
FIG. 7 is an exploded view of an animated toy constructed in accordance with a third embodiment of the present invention, illustrating the various components thereof.

Referring now to FIG. 7, there is depicted an exploded view of an animated toy 10*b* constructed in accordance with a third embodiment of the present invention. The animated toy 10*b* of the third embodiment is substantially similar in both structure and function to the animated toy 10*a* of the second embodiment. In this respect, the sole distinctions between the animated toy 10*b* of the third embodiment and the animated toy 10*a* of the second embodiment is that the lower end 26*b* of the left waist member 22*b* (as viewed from the front of the animated toy 10*b*) is formed to include an integral, inwardly extending flange portion 110 as an alternative to the above-described first tilt rack portion 32*a*. Formed within the distal section of the flange portion 110 is an elongate drive slot 112. The flange portion 110 is preferably formed on the front waist section 23*b* of the left waist member 22*b*. Additionally, the upper end 36*b* of the right leg member 34*b* (as viewed from the front of the animated toy 10*b*) is formed to include an integral, inwardly extending tab portion 114 as an alternative to the above-described second tilt rack portion 40*a* of the animated toy 10*a*. Extending inwardly from the tab portion 114 is a drive pin 116. The tab portion 114 is preferably formed on the front leg section 35*b* of the right leg member 34*b*.

In the animated toy 10*b*, the tab portion 114 is cooperatively engaged to the flange portion 110 via the receipt of the drive pin 116 into the drive slot 112. When cooperatively engaged to each other, the flange and tab portions 110, 114 mimic the function of the cooperatively engaged first and second tilt rack portions 32*a*, 40*a* of the animated toy 10*a* of the second embodiment. Thus, the tilting of the leg members 34*b* in unison in the first direction (to the left) results in the simultaneous tilting of the waist members 22*b* in the second direction (to the right), with the tilting of the leg members 34*b* in unison in the second direction (to the right) resulting in the simultaneous tilting of the waist members 22*b* in the first direction (to the left). Once again, it will be understood that the flange portion 110 may alternatively be formed on the lower end 26*b* of the right waist member 22*b*, and that the tab portion 114 may alternatively be formed on the upper end 36*b* of the left leg member 34*b*.

Figure 8A:
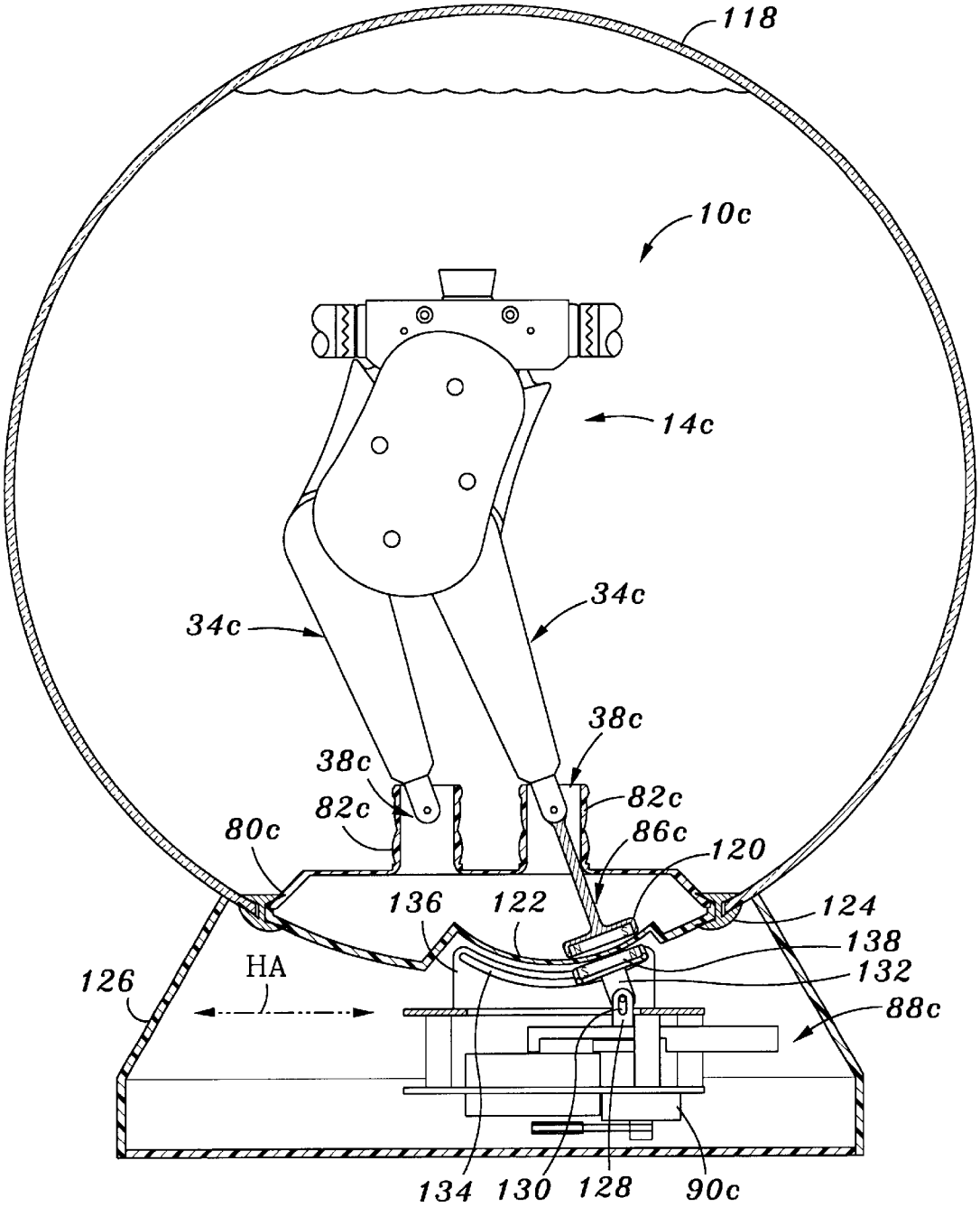
FIG. 8*a* is a front elevational view of an animated toy constructed in accordance with a fourth embodiment of the present invention specifically adapted for use in an aqueous environment, illustrating one limit of its range of motion.
Figure 8B:
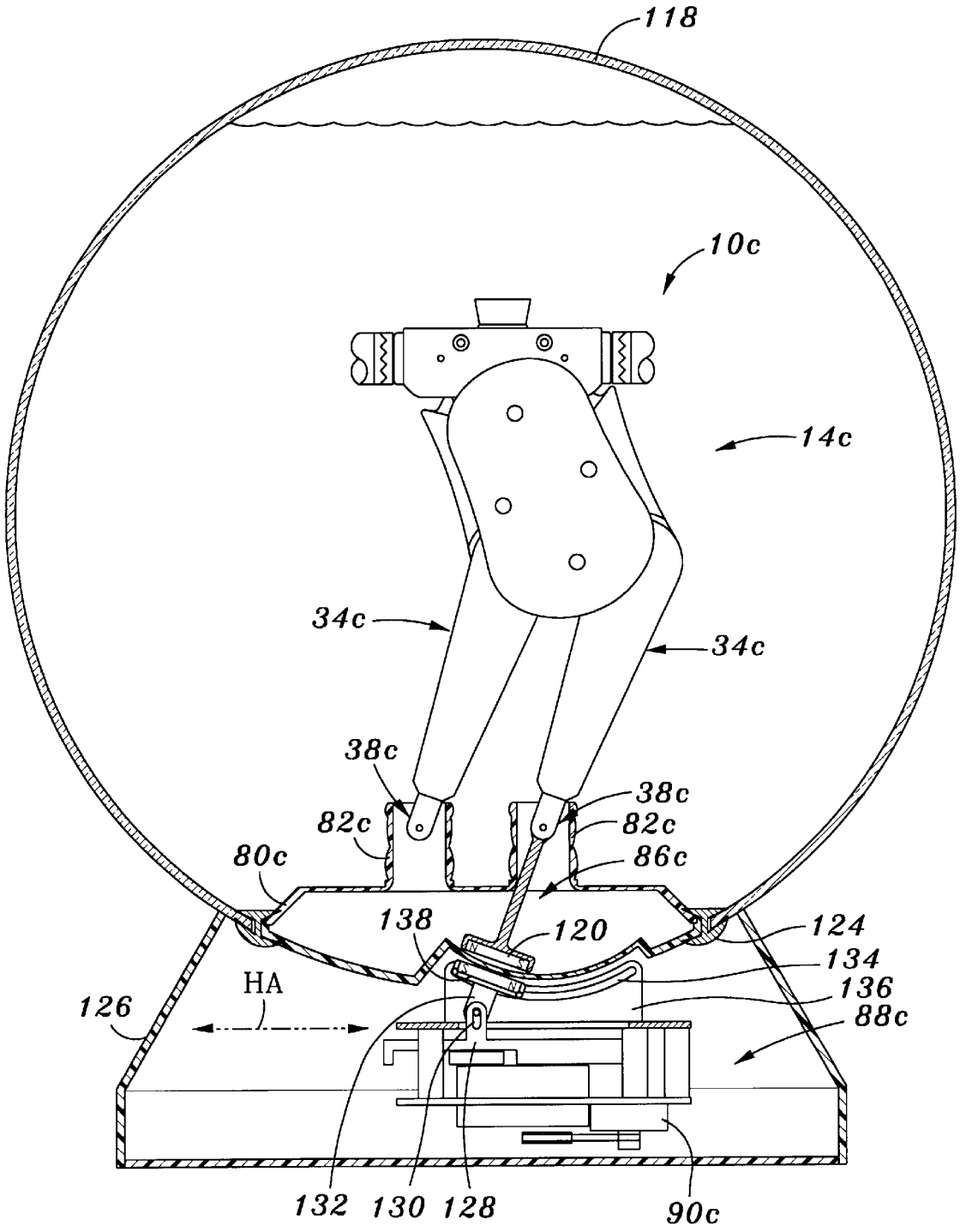
FIG. 8*b* is a front elevational view of the animated toy of the fourth embodiment similar to that shown in FIG. 8*a*, but illustrating the opposite limit of its range of motion.

Referring now to FIGS. 8*a* and 8*b*, there is depicted an animated toy 10*c* constructed in accordance with a fourth embodiment of the present invention which is particularly suited for use in an aqueous environment. The toy body 14*c* of the animated toy 10*c* is shown in FIGS. 8*a* and 8*b* as being disposed within the hollow interior of a spherically configured enclosure 118 which is commonly referred to as a water ball or glove, and is adapted to be filled with a quantity of liquid sufficient to completely immerse the toy body 14*c*. The toy body 14*c* of the animated toy 10*c* of the fourth embodiment may be configured to be virtually identical structurally and functionally to any one of the toy bodies 14, 14*a*, 14*b* of the first, second or third embodiments described above. In this respect, the only distinction between the toy body 14*c* and the toy bodies 14, 14*a*, 14*b* is that the main drive rack portion 86*c* extending downwardly from the lower end 38*c* of the right leg member 34*c* (as viewed from the front of the animated toy 10*c*) includes a leg magnet 120 disposed within its distal end as opposed to such distal end being formed to include gear teeth.

The animated toy 10*c* of the fourth embodiment includes a support base 80*c* which defines a spaced pair of foot portions 82*c* to which the lower ends 38*c* of the leg members 34*c* are pivotally connected. As is seen FIGS. 8*a* and 8*b*, the support base 80*c* is formed to include a lower, arcuate section 122. Additionally, the support base 80*c* is sized and configured to facilitate the fitting thereof into a complimentary opening within the spherically configured enclosure 118. More particularly, it is contemplated that the enclosure 118 will first be filled with a liquid, with the toy body 14*c* then being advanced into the interior thereof and the periphery of the support base 80*c* being engaged to the enclosure 118 via a sealing strip 124 which creates a fluid-tight seal therebetween. Thus, the sealing strip 124 prevents leakage of liquid from the joint defined between the support base 80*c* and the enclosure 118.

The animated toy 10*c* of the fourth embodiment includes a drive unit 88*c* which is structurally and functionally dissimilar to the drive units 88, 88*a*, 88*b* of the first, second and third embodiments, and is disposed within a support stand 126 specifically configured to support the enclosure 118. More particularly, the drive unit 88*c* includes a reversible motor 90*c* which is mechanically coupled to a primary drive member 128, and is operative to reciprocally move the primary drive member 128 back and forth along a horizontal axis HA. Disposed within the primary drive member 128 is a slot 130. The drive unit 88*c* further includes a secondary drive member 132 which is pivotally connected to the primary drive member 128 via the receipt of a pin protruding from the secondary drive member 132 into the slot 130. The secondary drive member 132 is also slidably movable within an arcuate slot 134 formed within a housing 136 of the drive unit 88*c*. Disposed within the distal end of the secondary drive member 132 is a drive magnet 138.

In the animated toy 10*c* of the fourth embodiment, due to the cooperative engagement between the primary and secondary drive members 128, 132, the movement of the primary drive member 128 back and forth along the horizontal axis HA results in the concurrent movement of the secondary drive member 132, and hence the drive magnet 138, back and forth along an arcuate magnet path which is dictated by the shape of the slot 134. Importantly, the housing 136 of the drive unit 88*c* is oriented relative to the arcuate section 122 of the support base 80*c* such that the drive magnet 138 is maintained in extremely close proximity to the outer surface of the arcuate section 122 as the drive magnet 138 is reciprocated back and forth along the magnet path. As is further seen in FIGS. 8*a* and 8*b*, the main drive rack portion 86*c* of the toy body 14*c* and support base 80*c* are sized and configured relative to each other such that as the leg members 34*c* tilt back and forth in the first and second directions, the leg magnet 120 moves in an arcuate path and is maintained in close proximity to the inner surface of the arcuate section 122 of the support base 80*c*.

In the animated toy 10*c* of the fourth embodiment, the drive magnet 138 magnetically cooperates with the leg magnet 120, with the force of magnetic attraction therebetween being maintained despite the intervening arcuate section 122 of the support base 80*c*. Thus, the movement of the drive magnet 138 along the magnet path to the right as viewed from the front of the animated toy 10*c* results in the concurrent movement of the leg magnet 120 in an arcuate path to the right, and resultant tilting of the leg members 34*c* in unison in the first direction (to the left) as shown in FIG. 8*a*. Conversely, the movement of the drive magnet 138 along the magnet path to the left as viewed from the front of the animated toy 10*c* results in the concurrent movement of the leg magnet 120 in an arcuate path to the left, and resultant tilting of the leg members 34*c* in unison in the second direction (to the right) as shown in FIG. 8*b*. As indicated above, the movement of the drive magnet 138 to the right along the magnet path is facilitated by the movement of the primary drive member 128 to the right along the horizontal axis HA as viewed from the front of the animated toy 10*c*, with the movement of the drive magnet 138 along, the magnet path to the left being facilitated by the movement of the primary drive member 128 to the left along the horizontal axis HA as viewed from the front of the animated toy 10*c*. The direction of movement of the primary drive member 128 along the horizontal axis HA is itself dictated by the direction of rotation of the drive shaft extending from the drive motor 90c. Those of ordinary skill in the art will recognize that the animated toy 10*c* need not necessarily include both the leg magnet 120 and drive magnet 138. In this respect, either the leg magnet 120 or drive magnet 138 may be replaced with a ferrous element(s).

Advantageously, the drive unit 88*c* of the animated toy 10*c* is not exposed to liquid within the interior of the enclosure 118. As indicated above, though the arcuate section 122 of the support base 80*c* separates the leg and drive magnets 120, 138 from each other, they are in sufficiently close proximity to each other so as to facilitate the necessary magnetic attraction. It is contemplated that particles may be included in the liquid within the interior of the enclosure 118 to simulate the effect of falling snow if the enclosure 118 is shaken.

Figure 10B:
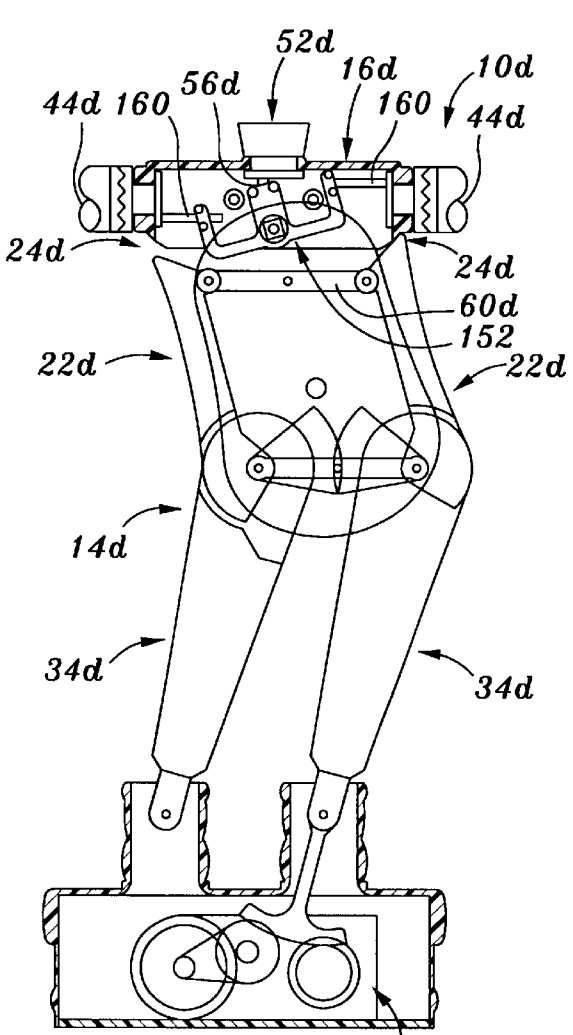
FIG. 10*b* is a front elevational view of the animated toy of the fifth embodiment similar to that shown in FIG. 10*a*, but illustrating the opposite limit of its range of motion.
Figure 10A:
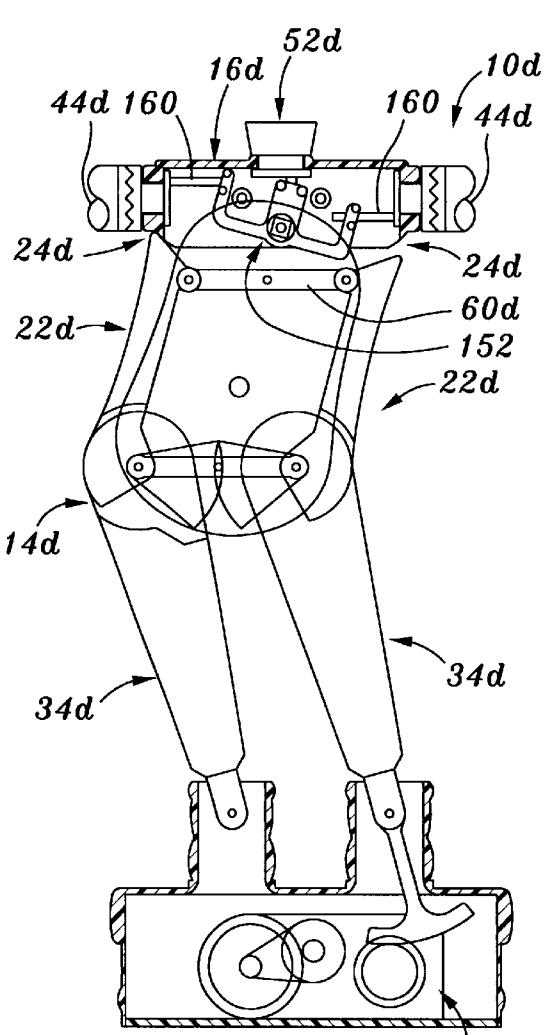
FIG. 10*a* is a front elevational view of the animated toy of the fifth embodiment similar to that shown in FIG. 9, illustrating one limit of its range of motion.
Figure 9:
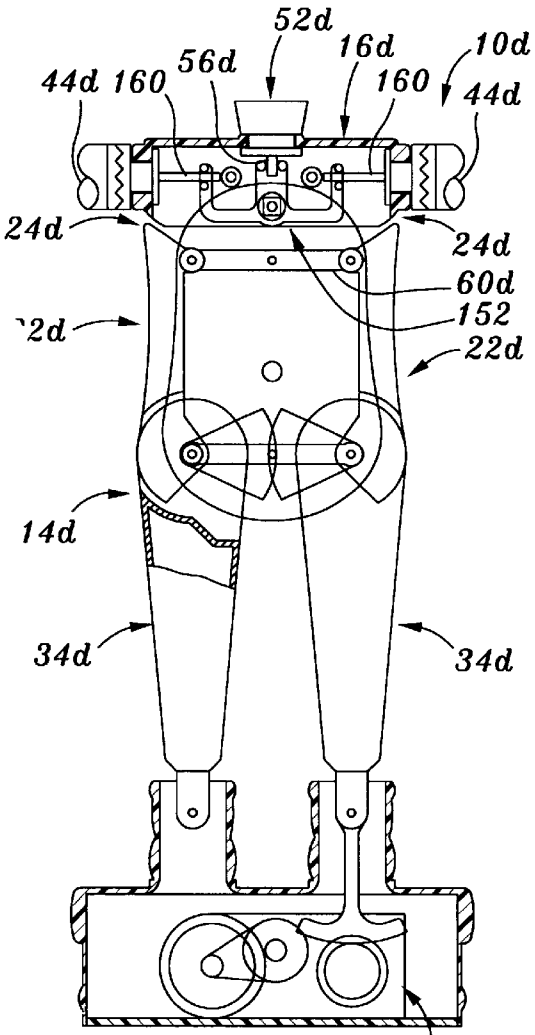
FIG. 9 is a front elevational view of an animated toy constructed in accordance with a fifth embodiment of the present invention excluding the front and back trunk plates.
Figure 11:
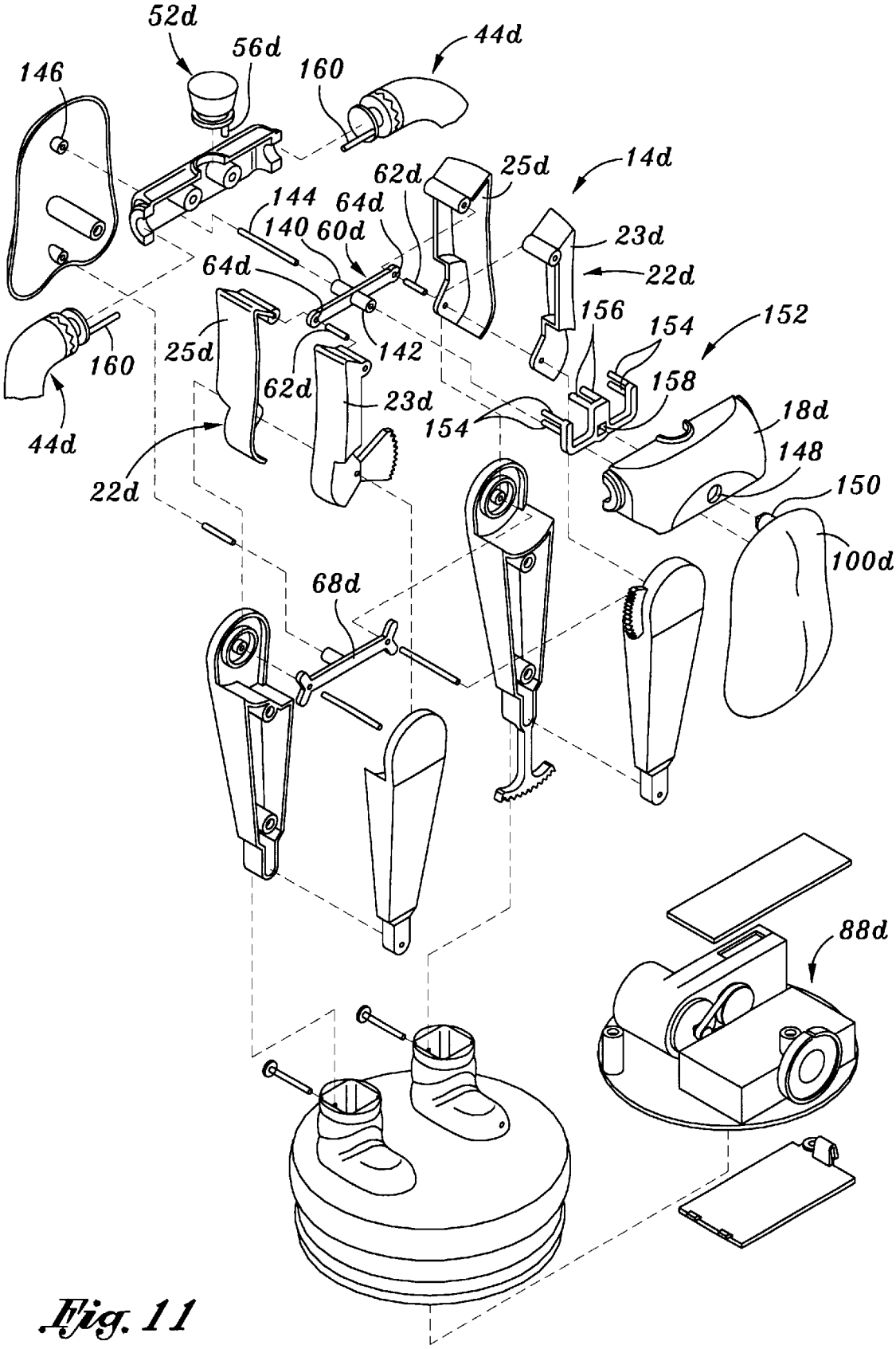
FIG. 11 is an exploded view of the animated toy of the fifth embodiment, illustrating the various components thereof.

Referring now to FIGS. 9–11, there is depicted an animated toy 10*d* constructed in accordance with a fifth embodiment of the present invention. The animated toy 10*d* of the fifth embodiment is substantially similar in structure and function to the above-described animated toy 10*a* of the second embodiment. Thus, the following discussion regarding the animated toy 10*d* of the fifth embodiment will be confined only to the particular structural distinctions between the same and the animated toy 10*a* of the second embodiment.

One of the primary distinctions between the animated toy 10*d* of the fifth embodiment and the animated toy 10*a* of the second embodiment is that the upper ends 24*d* of the waist members 22*d* in the toy body 14*d* of the animated toy 10*d* are not formed to include the waist rack portions 30*a* formed on the waist members 22*a* of the toy body 14*a*. Additionally, the upper support strut 60*d* of the toy body 14*d* has a configuration differing from that of the upper support strut 60*a* of the toy body 14*a*. In the toy body 14*d*, the upper strut 60*d* includes the apertures 64*d* disposed within respective ones of the opposed ends thereof. The upper support strut 60*d* is generally straight, with the opposed ends thereof being pivotally connected to the upper ends 24*d* of respective ones of the waist members 22*d*. Each of the opposed ends of the upper support strut 60*d* is positioned between the front and back waist sections 23*d*, 25*d* of respective ones of the waist members 22*d*. The pivotal connection of the upper support strut 60*d* to the waist members 22*d* is facilitated by the advancement of the pair of pivot pins 62*d* through respective ones of the apertures 64*d*, with the opposed ends of each pivot pin 62*d* being received into a pair of apertures disposed within respective ones of the front and back waist sections 23*d*, 25*d* of the corresponding waist member 22*d*.

As is best seen in FIG. 11, the upper support strut 60*d* is formed to include a coaxially aligned pair of cylindrically configured bosses 140, 142 which extend from opposite sides thereof. The bosses 140, 142 communicate with each other via a common bore extending axially therethrough. In the toy body 14*d*, the back trunk plate 102*d* is pivotally connected to both the lower support strut 68*d* and the upper support strut 60*d* via a pivot pin 144 which is advanced through the bore extending through the bosses 140, 142. One end of the pivot pin 144 is extended into a tubular boss 146 formed on the inner surface of the back trunk plate 102*d*. The end of the pivot pin 144 opposite the end received into the boss 146 is itself received into a complimentary tubular boss formed on the inner surface of the front trunk plate 100*d*. In the toy body 14*d*, the upper ends 24*d* of the waist members 22*d* are not attached or connected in any manner to the shoulder member 16*d*. Rather, the upper ends 24*d* of the waist members 22*d* are pivotally connected solely to respective ones of the opposed ends of the upper support strut 60*d* which, as indicated above, is itself pivotally connected to the front and back trunk plates 100*d*, 102*d*.

In the toy body 14*d* of the animated toy 10*d* of the fifth embodiment, the front shoulder member 18*d* of the shoulder member 16*d* is formed to include an aperture 148 which is sized and configured to slidably receive a peg 150 protruding inwardly from the inner surface of the front trunk plate 100*d*. The peg 150 is sized to protrude into the interior of the shoulder member 16*d* after being advanced through the aperture 148. The front trunk plate 100*d* is also attached to the back trunk plate 102*d*. The toy body 14*d* of the animated toy 10*d* further includes a cam member 152 which is rigidly attached to the peg 150 of the front trunk plate 100*d*. The cam member 152 has the general shape of a "W", and is formed to include two outer pairs of vertically spaced cam levers 154 and a central pair of horizontally spaced cam levers 156. The attachment of the cam member 152 to the front trunk plate 100*d* is facilitated by the advancement of the peg 150 into a corresponding opening 158 disposed within the cam member 152 below the central pair of cam levers 156 thereof.

In the toy body 14*d* of the fifth embodiment, each of the arm members 44*d* is formed to include an inwardly extending arm pin 160 as an alternative to the above-described pinion gear portions 48*a* of the arm members 44*a* of the toy body 14*a*. The arm pin 160 of each of the arm members 44*d* extends between a respective outer pair of cam levers 154 when the toy body 14*d* is properly assembled. Additionally, the head pin 56*d* protruding downwardly from the stem section 52*d* extends between the central pair of cam levers 156 when the toy body 14*d* is properly assembled.

In the animated toy 10*d* of the fifth embodiment, the drive unit 88*d* thereof is operative to reciprocally tilt the leg members 34*d* in unison in first and second directions. The tilting of the leg members 34*d* in unison in the first direction (to the left as viewed from the front of the animated toy 10*d*) causes the waist members 22*d* to be tilted in the second direction (to the right as viewed from the front of the animated toy 10*d*) as shown in FIG. 10*a*. Conversely, the tilting of leg members 34*d* in unison in the second direction (to the right) causes the waist members 22*d* to be tilted in the first direction (to the left) as shown in FIG. 10*b*. Additionally, in view of the above-described structure of the toy body 14*d*, the tilting of the leg members 34*d* in the first direction causes the front and back trunk plates 100*d*, 102*d*, and hence the cam member 152, to be tilted in the second direction, with the tilting of the leg members 34*d* in the second direction causing the front and back trunk plates 110*d*, 102*d*, and hence the cam member 152, to be tilted in the first direction. The tilting of the cam member 152 in the first and second directions causes the outer pairs of cam levers 154 to act against the arm pins 160 in a manner facilitating the alternate rotation of the arm members 44*d* in opposite directions. Further, the tilting of the cam member 152 in the first and second directions causes the central pair of cam levers 154 to act against the head pin 56*d* in a manner facilitating the alternate rotation of the stem section 52*d* in opposite directions.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. An animated toy, comprising:

a toy body comprising:

at least one shoulder member;

a pair of waist members having upper and lower ends, the upper end of each of the waist members being defined by a waist rack portion which is pivotally connected to the shoulder member;

a pair of arm members rotatably connected to the shoulder member each of the arm members including a pinion gear portion which protrudes therefrom and is cooperatively engaged to a respective one of the waist rack portions; and a pair of leg members having upper and lower ends, the lower ends of the waist members being pivotally connected to the upper ends of respective ones of the leg members;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members to be tilted in the second direction and the tilting of the leg members in the second direction causes the waist members to be tilted in the first direction, the cooperative engagement between the waist rack and pinion gear portions being such that the tilting of the waist members in the first and second directions causes the waist rack portions to act against the pinion gear portions in a manner facilitating the alternate rotation of the arm members in opposite directions.

2. The animated toy of claim 1 wherein the toy body further comprises a head member rotatably connected to the shoulder member and mechanically coupled to the waist members such that the tilting of the waist members in the first and second directions causes the head member to alternately rotate in different directions.

3. The animated toy of claim 2 wherein:

the toy body further comprises an upper support strut pivotally connected to and extending between the waist members such that the tilting of the leg members in the first direction causes the upper support strut to be tilted in the second direction, and the tilting of the leg members in the second direction causes the upper support strut to be tilted in the first direction;

the upper support strut includes a pair of cam levers protruding therefrom in spaced relation to each other;

the head member defines a central axis and includes a head pin protruding therefrom in radially off-set relation to the central axis; and the head pin extends between the cam levers such that the tilting of the upper support strut in the first and second directions causes the cam levers to act against the head pin in a manner facilitating the alternate rotation of the head member in opposite directions.

4. The animated toy of claim 1 wherein the toy body defines opposite sides and the leg member extending along one side of the toy body is mechanically coupled to the waist member extending along the other side thereof.

5. The animated toy of claim 4 wherein the toy body further comprises a lower support strut pivotally connected to and extending between the upper ends of the leg members.

6. The animated toy of claim 5 further comprising at least one trunk plate attached to the shoulder member.

7. The animated toy of claim 6 comprising a back trunk plate attached to the shoulder member and the lower support strut, and a front trunk plate attached to the shoulder member and the back trunk plate.

8. The animated toy of claim 4 wherein:

the lower end of one of the waist members includes a first tilt rack portion formed thereon; and the upper end of one of the leg members includes a second tilt rack portion formed thereon which is cooperatively engaged to the first tilt rack portion.

9. The animated toy of claim 8 wherein the drive unit is cooperatively engaged to the leg member having the second tilt rack portion formed thereon.

10. The animated toy of claim 8 wherein:

the toy body further comprises a drive strut pivotally connected to and extending between the upper ends of the leg members and a pair of drive gears rotatably connected to the drive strut and cooperatively engaged to each other; and the first and second tilt rack portions are cooperatively engaged to respective ones of the drive gears.

11. The animated toy of claim 4 wherein:

the lower end of one of the waist members includes a drive slot formed therein; and the upper end of one of the leg members includes a drive pin protruding therefrom which is movably received into the drive slot.

12. The animated toy of claim 11 wherein the drive unit is cooperatively engaged to the leg member having the drive pin protruding therefrom.

13. The animated toy of claim 1 wherein:

the lower end of one of the leg members includes a main drive rack portion formed thereon; and the motor of the drive unit is reversible and includes a main drive gear mechanically coupled thereto which is cooperatively engaged to the main drive rack portion such that the rotation of the main drive gear in a first direction facilitates the tilting of the leg members in the first direction and the rotation of the main drive gear in a second direction opposite the first direction facilitates the tilting of the leg members in a second direction.

14. The animated toy of claim 13 wherein the drive unit is mounted to the support base.

15. The animated toy of claim 14 wherein the reversible motor is disposed within the support base and the lower end of the leg member having the main drive rack portion formed thereon extends into the support base.

16. The animated toy of claim 1 wherein:

the lower end of one of the leg members includes at least one leg magnet disposed thereon; and the motor of the drive unit is mechanically coupled to at least one drive magnet of the drive unit in a manner wherein the motor is operative to reciprocally move the drive magnet in a first magnet path and a second magnet path opposite the first magnet path;

the drive magnet magnetically cooperating with the leg magnet such that the movement of the drive magnet along the first magnet path facilitates the tilting of the leg members in the first direction, with the movement of the drive magnet along the second magnet path facilitating the tilting of the leg members in the second direction.

17. The animated toy of claim 16 wherein the first and second magnet paths are arcuate.

18. The animated toy of claim 16 further in combination with a hollow enclosure, the support base and the toy body being disposed within the enclosure and the drive unit being disposed exteriorly of the enclosure.

19. The animated toy of claim 18 wherein the enclosure is spherically shaped.

20. The animated toy of claim 1 further in combination with a decorative annular wreath defining an open interior region, the support base being mounted to the wreath such that the toy body extends into the interior region thereof.

21. The animated toy of claim 1 wherein the support base includes a pair of foot portions formed thereon, the lower ends of the leg members being pivotally connected to respective one of the foot portions.

22. The animated toy of claim 1 wherein:

the lower end of one of the leg members includes at least one ferrous element disposed thereon; and the motor of the drive unit is mechanically coupled to at least one drive magnet of the drive unit in a manner wherein the motor is operative to reciprocally move the drive magnet in a first magnet path and a second magnet path opposite the first magnet path;

the drive magnet magnetically cooperating with the ferrous element such that the movement of the drive magnet along the first magnet path facilitates the tilting of the leg members in the first direction, with the movement of the drive magnet along the second magnet path facilitating the tilting of the leg members in the second direction.

23. The animated toy of claim 22 wherein the first and second magnet paths are arcuate.

24. The animated toy of claim 1 wherein:

the lower end of one of the leg members includes at least one leg magnet disposed thereon; and the motor of the drive unit is mechanically coupled to at least one ferrous element of the drive unit in a manner wherein the motor is operative to reciprocally move the ferrous element in a first magnet path and a second magnet path opposite the first magnet path;

the leg magnet magnetically cooperating with the ferrous element such that the movement of the ferrous element along the first magnet path facilitates the tilting of the leg members in the first direction, with the movement of the ferrous element along the second magnet path facilitating the tilting of the leg members in the second direction.

25. The animated toy of claim 24 wherein the first and second magnet paths are arcuate.

26. An animated toy, comprising:

a toy body comprising:

at least one shoulder member;

an upper support strut pivotally connected to the shoulder member;

a pair of waist members having upper and lower ends, the upper ends of the waist members being pivotally connected to the upper support strut;

a pair of leg members having upper and lower ends, the lower ends of the waist members being pivotally connected to the upper ends of respective ones of the leg members;

a lower support strut pivotally connected to and extending between the upper ends of the leg members;

a back trunk plate pivotally connected to the upper and lower support struts;

a front trunk plate pivotally connected to the shoulder member and the back trunk plate;

a cam member attached to the front trunk plate and movable therewith; and a pair of arm members rotatably connected to the shoulder member and mechanically coupled to the cam member so as to be alternately movable in different directions thereby;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members and the front and back trunk plates to be tilted in the second direction and the tilting of the leg members in the second direction causes the waist members and the front and back trunk plates to be tilted in the first direction, the arm members being mechanically coupled to the cam member such that the tilting of the cam member in the first and second directions causes the arm members to alternately move in different directions.

27. The animated toy of claim 26 wherein the toy body further comprises a head member rotatably connected to the shoulder member and mechanically coupled to the cam member such that the tilting of the cam member in the first and second directions causes the head member to alternately rotate in different directions.

28. The animated toy of claim 27 wherein:

the cam member includes a central pair of cam levers and two outer pairs of cam levers protruding therefrom;

each of the arm members includes an arm pin which protrudes therefrom;

the head member defines a central axis and includes a head pin protruding therefrom in radially off-set relation to the central axis;

the arm pin of each of the arm members extends between a respective outer pair of cam levers such that the tilting of the cam member in the first and second directions causes the outer pairs of cam levers to act against the arm pins in a manner facilitating the alternate rotation of the arm members in opposite directions; and the head pin extends between the central pair of cam levers such that the tilting of the cam member in the first and second directions causes the central pair of cam levers to act against the head pin in a manner facilitating the alternate rotation of the head member in opposite directions.

29. The animated toy of claim 28 wherein the central and outer pairs of cam levers protrude from a common side of the cam member.

30. The animated toy of claim 26 wherein the toy body defines opposite sides and the leg member extending along one side of the toy body is mechanically coupled to the waist member extending along the other side thereof.

31. The animated toy of claim 30 wherein:

the lower end of one of the waist members includes a first tilt rack portion formed thereon; and the upper end of one of the leg members includes a second tilt rack portion formed thereon which is cooperatively engaged to the first tilt rack portion.

32. The animated toy of claim 31 wherein the drive unit is cooperatively engaged to the leg member having the second tilt rack portion formed thereon.

33. An animated toy, comprising:

a toy body comprising:

at least one shoulder member;

a pair of waist members having upper and lower ends, the upper ends of the waist members being pivotally connected to the shoulder members;

a pair of arm members rotatably connected to the shoulder member and mechanically coupled to the upper ends of respective ones of the waist members;

a head member rotatably connected to the shoulder member and mechanically coupled to the waist members, the head member defining a central axis and including a head pin protruding therefrom in radially off-set relation to the central axis;

an upper support strut pivotally connected to and extending between the waist members, the upper support strut including a pair of cam levers protruding therefrom in spaced relation to each other, with the head pin extending between the cam levers; and a pair of leg members having upper and lower ends, the lower ends of the waist members being pivotally connected to the upper ends of respective ones of the leg members;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members and the upper support strut to be tilted in the second direction and the tilting of the leg members in the second direction causes the waist members and the upper support strut to be tilted in the first direction, the arm members being mechanically coupled to the waist members such that the tilting of the waist members in the first and second directions causes the arm members to alternately move in different directions, with the tilting of the upper support strut in the first and second directions causing the cam levers to act against the head pin in a manner facilitating the alternate rotation of the head member in opposite directions.

34. An animated toy, comprising:

a toy body comprising:

at least one shoulder member;

a pair of waist members having upper and lower ends, the upper ends of the waist members being pivotally connected to the shoulder member, with the lower end of one of the waist members including a first tilt rack portion formed thereon;

a pair of leg members having upper and lower ends, the lower ends of the waist members being pivotally connected to the upper ends of respective ones of the leg members, with the upper end of one of the leg members including a second tilt rack portion formed thereon;

a drive strut pivotally connected to and extending between the upper ends of the leg members; and a pair of drive gears rotatably connected to the drive strut and cooperatively engaged to each other, the first and second tilt rack portions being cooperatively engaged to respective ones of the drive gears;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members to be tilted in the second direction and the tilting of the leg members in the second direction causes the waist members to be tilted in the first direction.

35. An animated toy, comprising:

a toy body comprising:

at least one shoulder member;

a pair of waist members having upper and lower ends, the upper ends of the waist members being pivotally connected to the shoulder member and the lower end of one of the waist members including a drive slot formed therein; and a pair of leg members having upper and lower ends, the lower ends of the waist members being pivotally connected to the upper ends of respective ones of the leg members, with the upper end of one of the leg members including a drive pin protruding therefrom which is movably received into the drive slot;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members to be tilted in the second direction and the tilting of the leg members in the second direction causes the waist members to be tilted in the first direction.

36. The animated toy of claim 35 wherein the drive unit is cooperatively engaged to the leg member having the drive pin protruding therefrom.

37. An animated toy, comprising:

a toy body comprising:

at least one shoulder member;

an upper support strut pivotally connected to the shoulder member;

a pair of waist members having upper and lower ends, the upper ends of the waist members being pivotally connected to the upper support strut;

a pair of leg members having upper and lower ends, the lower ends of the waist members being pivotally connected to the upper ends of respective ones of the leg members;

a lower support strut pivotally connected to and extending between the upper ends of the leg members;

a back trunk plate pivotally connected to the upper and lower support struts;

a front trunk plate pivotally connected to the shoulder member and the back trunk plate;

a cam member attached to the front trunk plate and moveable therewith, the cam member including a central pair of cam levers and two outer pairs of cam levers protruding therefrom;

a pair of arm members rotatably connected to the shoulder member, each of the arm members including an arm pin which protrudes therefrom and extends between a respective outer pair of cam levers; and a head member rotatably connected to the shoulder member, the head member defining a central axis and including a head pin protruding therefrom in radially off-set relation to the central axis, with the head pin extending between the central pair of cam levers;

a support base, the lower ends of the leg members being pivotally connected to the support base; and a drive unit disposed adjacent to the support base and including a motor which is cooperatively engaged to at least one of the leg members and operative to reciprocally tilt the leg members in first and second directions;

the toy body being configured such that the tilting of the leg members in the first direction causes the waist members, the front and back trunk plates, and the cam member to be tilted in the second direction and the tilting of the leg members in the second direction causes the waist members, the front and back trunk plates, and the cam member to be tilted in the first direction, the tilting of the cam member in the first and second directions causing the outer pairs of cam levers to act against the arm pins in a manner facilitating the alternate rotation of the arm members in opposite directions and the central pair of cam levers to act against the head pin in a manner facilitating the alternate rotation of the head member in opposite directions.

38. The animated toy of claim 37 wherein the central and outer pairs of cam levers protrude from a common side of the cam member.

* * * * *